US005220387A

United States Patent [19]

Tsunoda et al.

[11] Patent Number: 5,220,387

[45] Date of Patent: Jun. 15, 1993

[54] TRANSFER UNIT OF AN IMAGE FORMING APPARATUS

[75] Inventors: Arihiro Tsunoda, Higashiosaka; Atsushi Kanou, Amagasaki; Toshiyuki Osaka, Osaka; Toshinobu Katafuchi, Fujiidera; Syuji Yamada, Kobe; Naoki Mizutani, Takarazuka, all of Japan

[73] Assignee: Mita Industrial Co., Ltd., Japan

[21] Appl. No.: 789,647

[22] Filed: Nov. 8, 1991

[30] Foreign Application Priority Data

Nov. 14, 1990 [JP] Japan ..... 2-309401
Nov. 22, 1990 [JP] Japan ..... 2-320039

[51] Int. Cl.[5] ..... G03G 15/01

[52] U.S. Cl. ..... 355/274; 271/162; 346/160.1; 355/277

[58] Field of Search ..... 355/277, 271, 273, 274, 355/309, 316, 200, 308, 326, 327; 271/162, 127, 153.1; 346/150, 160.1, 136, 145

[56] References Cited

U.S. PATENT DOCUMENTS

| | | | |
|---|---|---|---|
| 2,968,553 | 1/1961 | Gundlach . | |
| 3,751,156 | 8/1973 | Kzostak et al. | 355/277 X |
| 4,257,700 | 3/1981 | Tsuda et al. | 355/277 X |
| 4,739,362 | 4/1988 | Kau et al. | 355/277 X |
| 4,760,411 | 7/1988 | Ohmura et al. | 346/160.1 |
| 4,873,541 | 10/1989 | Hirose et al. | 346/160.1 |
| 4,887,101 | 12/1989 | Hirose et al. | 346/134 |
| 4,905,048 | 2/1990 | Suzuki | 355/271 |
| 4,931,839 | 6/1990 | Tompkins et al. | 355/277 |
| 4,947,214 | 8/1990 | Baxendell et al. | 355/274 |
| 5,041,871 | 8/1991 | Hata | 355/200 |
| 5,043,761 | 8/1991 | Johnson | 355/326 |
| 5,053,828 | 10/1991 | Ndebi et al. | 355/285 |
| 5,054,762 | 10/1991 | Kodana | 271/162 |

OTHER PUBLICATIONS

Patent Abstracts of Japan, vol. 11, No. 35 (P-542) Feb. 3, 1987 & JP-A-61 205 956 (Canon K.K.) Sep. 12, 1986.
Patent Abstracts of Japan, vol. 14, No. 508 (P-1128) Nov. 7, 1990 & JP-A-22 11 462 (Canon K.K.) Aug. 22, 1990.
Patent Abstracts of Japan, vol. 11, No. 103 (P-562) (2550) Apr. 2, 1987 & JP-A-61 252 567 (Canon K.K.) Nov. 10, 1986.
Patent Abstracts of Japan, vol. 11, No. 12 (P-535) (2459) Jan. 13, 1987 & JP-A⊕186 971 (Canon K.K.).
Patent Abstracts of Japan vol. 12, No. 453 (P-792 Nov. 29, 1988 & JP-A-63 177 182 (Canon K.K.) Jul. 21, 1988.

*Primary Examiner*—A. T. Grimley
*Assistant Examiner*—T. A. Dang
*Attorney, Agent, or Firm*—Beveridge, DeGrandi & Weilacher

[57] ABSTRACT

A transfer unit of an image forming apparatus includes a transfer device, a pressing member, and a regulative member. The transfer device is provided adjacent to a photoconductor of the image forming apparatus and is separable from the photoconductor under its own weight. The pressing member presses the transfer device against the photoconductor. The regulative member regulates the distance by which transfer device is separated from the photoconductor when the pressing member disengages the transfer device therefrom. In this transfer unit, if a printing sheet is large, the pressing member disengages the transfer device after a given transfer operation. As a result, the transfer device separates from the photoconductor under its own weight, with the distance separating the transfer device from the photoconductor being regulated by the regulative member. Then, the transfer device idles in the separated state, wherein preparation for a subsequent transfer operation is made. In this manner, the transfer device is idled simply by regulating the movement of the transfer device through means of the regulative member. Consequently, little distortion occurs to the transfer unit support frames, and deterioration of the quality of the transferred images is thus checked.

28 Claims, 17 Drawing Sheets

TRANSFER UNIT OF AN IMAGE FORMING APPARATUS

BACKGROUND OF THE INVENTION

The present invention relates generally to a transfer unit of an image forming apparatus and particularly to a transfer unit provided in an image forming apparatus such as a full-color copying machine.

In the full-color copying machine, a transfer drum is generally provided adjacent to a photoconductor drum. Printing paper is wound on the outer surface of the transfer drum, wherein an image formed on the photoconductor drum is transferred onto the printing paper on the transfer drum when pressed against the photoconductor drum.

In the case of color image formation processing onto large-size printing paper wound on such a transfer drum, it is impractical to transfer images of respective colors for each rotation of the drum, since the transfer drum rotates relatively rapidly compared with the operation speeds of the associated components. Therefore, when an image is to be transferred onto large-size printing paper wound on the transfer drum, each time an image of one color has been transferred onto the paper, the transfer drum is run in an idle state for one rotation, so that the respective components may be returned to their initial positions during the idle running of the drum. An image of another color is then transferred onto the paper during the next rotation of the drum. The transfer drum is separated slightly from the photoconductor drum while it is running idle so that toner remaining on the photoconductor drum does not adhere to the printing paper wound on the transfer drum. While the transfer drum is separated from the photoconductor drum, gears coupling these drums remain engaged with each other.

In order that the transfer drum be pressed against or separated from the photoconductor drum, it is supported by a rotatable frame. This frame is impelled toward the photoconductor drum through the agency of a pressing spring, whereby the transfer drum is pressed against the photoconductor drum during a copying operation. When the transfer drum is to run idle, the frame is rotated in the direction away from the photoconductor drum and in opposition to the spring by means of a cam provided in the frame toward the rear of the machine. As a result, a predetermined gap is given between the transfer drum and the photoconductor drum.

In order to dismount the transfer drum from the copying machine body in case of malfunction such as a paper jam, the pressing spring is disengaged, whereby the transfer drum may be detached from the photoconductor drum. Only while the two drums thus are not in contact with each other can the transfer drum be removed from the copying machine body.

In the structure of a conventional machine as described above, the frame supporting the transfer drum is pushed toward the photoconductor drum by means of the spring. The transfer drum is separated from the photoconductor drum by means of the cam. In order to effect this separation the cam presses only one point of a rear portion of the transfer unit. Consequently the frame is distorted, creating between the drums a larger gap toward the rear of the unit, where the cam is provided, than toward the front. Then if an adequate gap is to be provided toward the front of the unit, the gap resulting toward the rear will be considerably large, resulting in increased backlash from the transmission gears provided in the two drums, and causing deviations in the color images or other effects unfavorable to the full-color copying process.

Particularly, the structure of the conventional machine is such that it is necessary to impel the transfer drum and the frame supporting it toward the photoconductor drum by means of a pressing spring, which accordingly must have a considerably large coefficient of elasticity. Consequently, when the transfer drum is separated from the photoconductor drum by such a force as to overcome the elasticity of the spring, the frame is subject to considerable distortion.

The frame supporting the transfer drum has side walls on front and rear of the transfer drum. A guide path for guiding paper to the transfer drum is disposed between the front and rear side walls. A sheet fed to the transfer drum through the guide path is nipped by a clip provided in the transfer drum, whereby it is wound onto the transfer drum.

If the clip fails to nip the printing sheet, the sheet halts in the guide path, leading to a paper jam. In this state, when the transfer drum is drawn out in the axial direction of the drum in order to remedy the jam, the leading edge of the jammed printing sheet may catch on the rear side wall of the frame and become torn, or the printing sheet when caught on the rear side wall, may impede the transfer drum from being drawn out further, making it difficult to handle the paper jam.

SUMMARY OF THE INVENTION

An object of the present invention is to ensure uniformity in the gap between the transfer unit and the photoconductor drum of an image forming apparatus, along the direction from the front to the rear of the apparatus, and to improve the success of good quality image transfer.

Another object is to provide a transfer unit of an image forming apparatus which can be readily brought into any of three states, viz., a transfer state, an idle running state and a detachable state.

Still another object of the present invention is to avert the bumping of the transfer unit against the photoconductor when the transfer unit is mounted into or dismounted from an image forming apparatus.

A further object is to afford ease of operation in mounting a transfer unit into and dismounting it from an image forming apparatus while guaranteeing that collision between the transfer unit and the image forming apparatus will be avoided.

One other object of the present invention is to afford ease in remedying a paper jam associated with the transfer unit of an image forming apparatus in the event such a paper jam occurs. (1) A transfer unit of an image forming apparatus according to an aspect of the present invention includes a transfer device, a pressing mechanism, and a regulative mechanism.

The transfer device is provided adjacent to the photoconductor of the image forming apparatus, and is detachable from the photoconductor under its own weight. The pressing mechanism presses the transfer device against the photoconductor. The regulative mechanism regulates the distance between the transfer device and the photoconductor upon release of the pressing action by the pressing mechanism.

For the performance of a transfer operation by this transfer unit, the pressing mechanism presses the transfer device against the photoconductor, whereupon an image formed on the photoconductor is transferred onto a printing sheet wound on the transfer device.

If the printing sheet is large, the pressing mechanism releases the pressing action after the transfer operation. As a result, the transfer device separates from the photoconductor under its own weight. At the same time, the distance between the transfer device and the photoconductor is regulated by the regulating mechanism. The transfer device then idles in the state separated from the photoconductor, meanwhile the transfer unit is prepared for a subsequent transfer operation.

Thus, when the transfer device idles, the regulating mechanism need only regulate the movement of the transfer device, making it unnecessary to press the frame of the transfer device in opposition to the elasticity of a spring, as in a conventional apparatus. Consequently, less distortion occurs to the frame of the transfer device during its idle running, in comparison to a conventional apparatus. Furthermore, there is little variation along the gap between the transfer drum and the photoconductor from rearward of the apparatus toward the front, effecting a reduction in transmission gear backlash, the occurrence of which otherwise lead to color deviation or other unfavorable phenomena. (2) A transfer unit of an image forming apparatus according to another aspect of the present invention can be mounted into and removed from the image forming apparatus, and it includes a transfer device, a position control mechanism, a manipulation device, and a coupling mechanism.

The transfer device is provided adjacent to a photoconductor of the image forming apparatus, and is movable away from the photoconductor. The position control mechanism is provided on both ends of the transfer unit along the axial direction of the transfer drum, and assumes a first position, in which the transfer device is pressed against the photoconductor, and second and third positions, in which the transfer device is spaced from the photoconductor by a first distance and a greater second distance, respectively, thereby controlling positioning of the transfer device. The manipulation device is movable between a mount position and a dismount position, wherein the transfer device is mounted into and dismounted from the image forming apparatus. The coupling mechanism couples the manipulation device with the position control mechanism such that the position control mechanism is in the second position when the manipulation device is in the mount position, and that the position control mechanism is in the third position when the manipulation device is in the dismount position.

In this transfer unit, the positioning of the transfer device is controlled by the position control mechanism. When a transfer operation is performed, the transfer device is thereby pressed against the photoconductor. Wherein the transfer device is idled due to the large size of a printing sheet, the transfer device is retained apart from the photoconductor by the first distance. In order to remove the transfer device from the image forming apparatus, the transfer device is separated from the photoconductor by the second distance greater than the first distance.

In this transfer unit, the manipulation device is coupled with the position control mechanism by means of the coupling mechanism. Consequently, wherein the transfer device is close to the photoconductor the manipulation device is in the mount position, and the position control mechanism is in the second position. When the manipulation device is in the dismount position, the position control mechanism assumes the third position, whereby the transfer device is spaced clear of the photoconductor.

Accordingly, the transfer device is made to idle when the position control mechanism is in the second position, and can be mounted into or dismounted from the image forming apparatus when the position control mechanism is in the third position. Since the transfer device is set into appropriate position automatically by the operation of the manipulation device, prevention of erroneous operation and improved handling in mounting and dismounting of the transfer device are achieved. (3) A transfer unit of an image forming apparatus according to a further aspect of the present invention is mountable into and removable from the image forming apparatus, and it includes a transfer device, a position control mechanism, a manipulation device, a manipulation device position control mechanism, and a coupling mechanism.

The transfer device is provided adjacent to the photoconductor of the image forming apparatus, and can be spaced from the photoconductor. The position control mechanism, in acting to control the position of the transfer device, assumes a first position in which the transfer device is pressed against the photoconductor, and second and third positions in which the transfer device is spaced from the photoconductor by a first distance and a greater second distance. The manipulation device is movable between a mount position and a dismount position, wherein the transfer device is mounted into or dismounted from the image forming apparatus. The manipulation device position control mechanism brings the manipulation device into the mount position when the transfer device is mounted into the image forming apparatus. The coupling mechanism couples the manipulation device with the position control mechanism, whereby the position control mechanism is in the second position when the manipulation device is in the mount position.

In this transfer unit, the transfer device is so controlled as to be in a position in which it is pressed against the photoconductor, in a position in which it idles, and in a dismount position in which it is separated clear of the photoconductor, by means of the position control mechanism as described above. The manipulation device of the transfer unit is brought into the mounting position when the transfer device is mounted into the image forming apparatus, wherein the position control mechanism assumes the second position when the manipulation device is in the mounting position.

Consequently, when the transfer device is mounted into the image forming apparatus, the manipulation device automatically is brought into the mount position, whereby the transfer device is automatically spaced from the photoconductor by the first distance. Thus, simply by mounting the transfer device into the image forming apparatus, the respective components can be automatically placed in their appropriate positions. Accordingly, erroneous operation in mounting and dismounting of the transfer device is averted, and ease of handling is improved. (4) A transfer unit of an image forming apparatus according to a still further aspect of the present invention is mountable into and dismountable from the image forming apparatus, and it includes a transfer device, and first and second support plates.

The transfer device functions to retain printing material on its surface. The first and second support plates are disposed on both ends of the transfer device along its installation/removal direction, and support the transfer device. At least one or the other of the first and second support plates in the rear of the image forming apparatus contains a cutout corresponding to a cross section of the printing material supply path to the transfer device.

In this transfer unit, the support plate on the rear side of the image forming apparatus includes the cutout as described above. Consequently, when the transfer unit is removed from the image forming apparatus in an instance of paper jam, the printing material will not catch on the support plate; thus the paper jam is more easily remedied.

The foregoing and other objects and advantages of the present invention will be more fully apparent from the following detailed description.

DESCRIPTION OF THE PREFERRED EMBODIMENTS

First Embodiment

Figure 1:
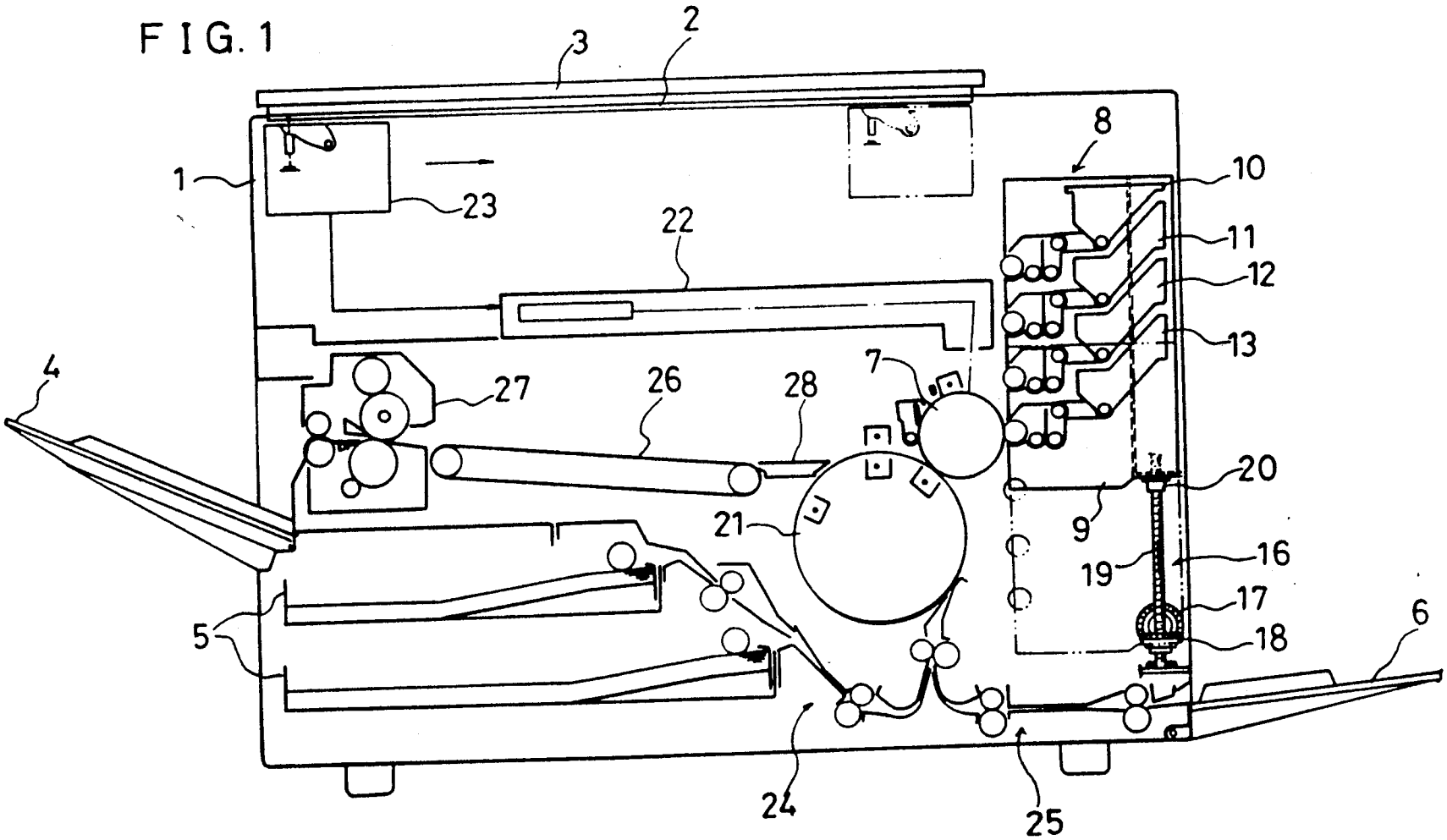
FIG. 1 is a schematic elevational view of a full-color copying machine in which a transfer unit according to a first embodiment of the present invention is incorporated.

In reference to FIG. 1, an original retainer 2 on which an original is retained is disposed in an upper portion of a copying machine body 1, and a raisable original cover 3 is provided over the upper surface of the original retainer 2. A copy tray 4 is disposed on the left side of the body 1, and a plurality of feed cassettes 5 are disposed detachably in a left bottom portion of the body 1. A bypass feed tray 6 is disposed on the right side of the body 1.

A photoconductor drum 7 is provided inside the copying machine body 1. A transfer unit 30 including a transfer drum 21 is provided adjacent to the photoconductor drum 7. A charger, a sheet separating unit, and a cleaning unit, as well as a developing section 8 including vertically arranged developing units 10, 11, 12 and 13, are further provided in the region surrounding the photoconductor drum 7. The developing units, in vertical order from the uppermost to the lowermost, are the magenta developing unit 10, cyan developing unit 11, yellow developing unit 12, and black developing unit 13. These developing units 10 through 13 are fixed to a frame 9, which is vertically movable by means of a moving mechanism 16.

The moving mechanism 16 of the developing section 8 includes a stepping motor, bevel gears 17 and 18 coupled to the stepping motor, a ball screw 19 extending vertically and fixed to the bevel gear 18, and a nut 20 fitted onto the ball screw 19.

The transfer drum 21 is disposed under and alongside the photoconductor drum 7. A laser unit 22 is disposed above the photoconductor drum 7. A laser beam from the laser unit 22 irradiates the upper surface of the photoconductor drum 7. A reader 23 comprising CCDs is disposed under the original retainer 2. The reader 23 is conveyed crosswise relative to the figure, thereby to scan an original placed on the original retainer 2. Image information obtained by the reader 23 is transmitted as an electric signal to the laser unit 22.

Sheet transport paths 24 and 25 are provided under the transfer drum 21 between the feed cassettes 5 and the bypass feed tray 6. The sheet transport paths 24 and 25 include sheet guides and feed rollers. A discharged sheet transport path 26 and an image fixing unit 27 are provided between the transfer drum 21 and the copy tray 4. A separation claw 28, which separates the printing sheet from the transfer drum 21, is provided between the transfer drum 21 and the discharged sheet transport path 26.

The transfer unit 30 will now be specifically described.

Figure 2:
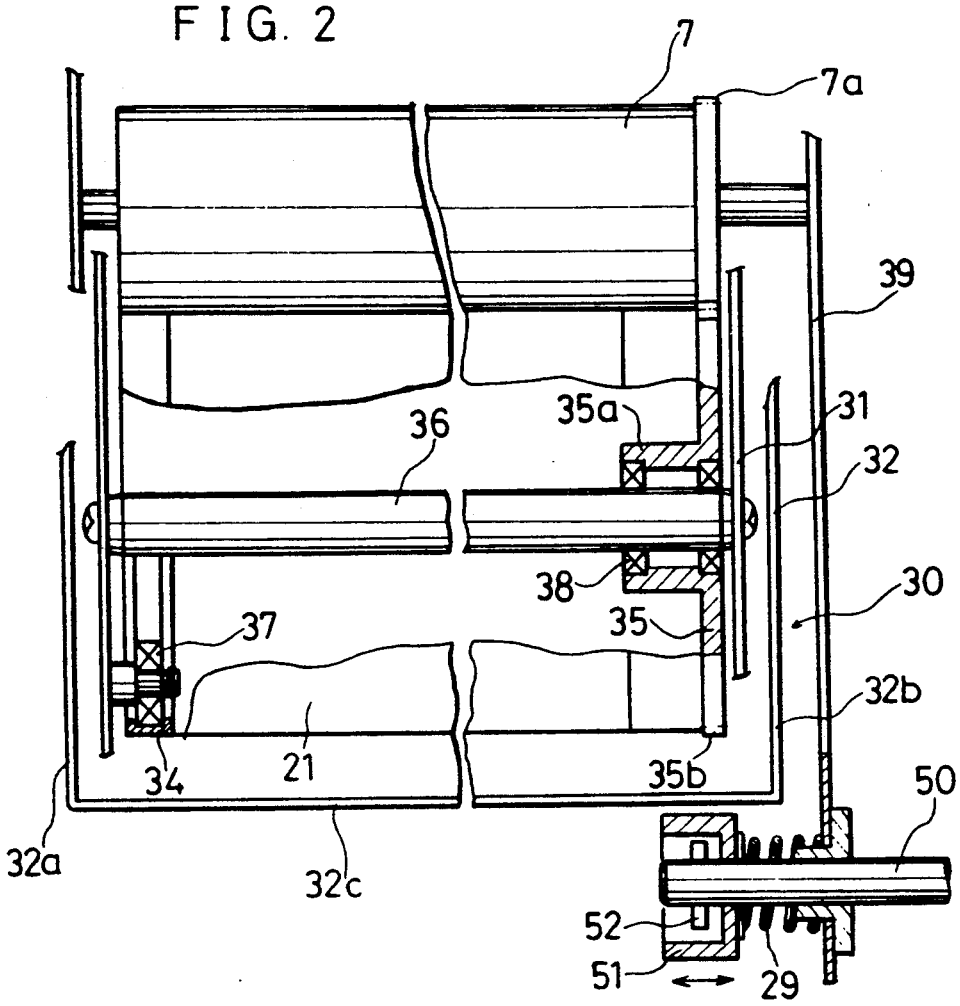
FIG. 2 is a partly in sectional view of the transfer unit.
Figure 3:
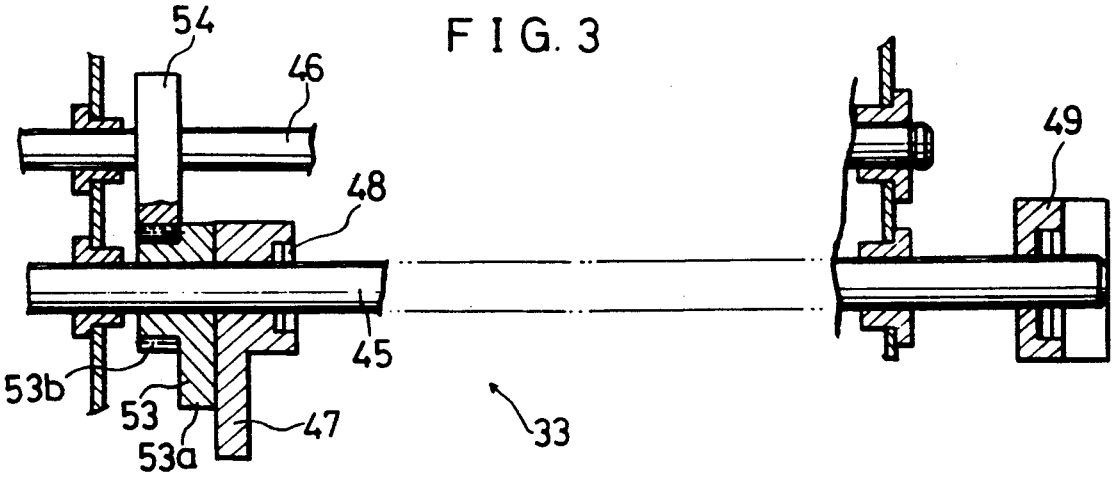
FIG. 3 is a fragmentary side view of the pressing and regulating mechanisms of the transfer unit.

Referring to FIGS. 1, 2 and 3, the transfer unit 30 includes the transfer drum 21, an inner frame 31 supporting the transfer drum 21, an outer frame 32, and a regulating mechanism 33 for controlling position of the transfer drum 21.

The transfer drum 21 has rotating frames 34 and 35 on its front and rear end surfaces. A drum shaft 36 penetrates the respective centers of the rotatory frames 34 and 35, and both ends of the drum shaft 36 are fixed into the inner frame 31. The rotatory frame 34 is rotatably supported by a plurality of bearings 37 provided inward of the inner frame 31. The rotating frame 35 has a boss 35*a* at its center, which is born by the drum shaft 36 through bearings 38. A gear portion 35*b*, engaging with a gear 7*a* formed on one end of the photoconductor drum 7, is formed along the circumference of one end of the rotating frame 35.

The outer frame 32 includes front and rear side walls 32*a* and 32*b* (first and second support plates), and a bottom wall 32*c* joining the side walls 32*a* and 32*b*.

Figure 4:
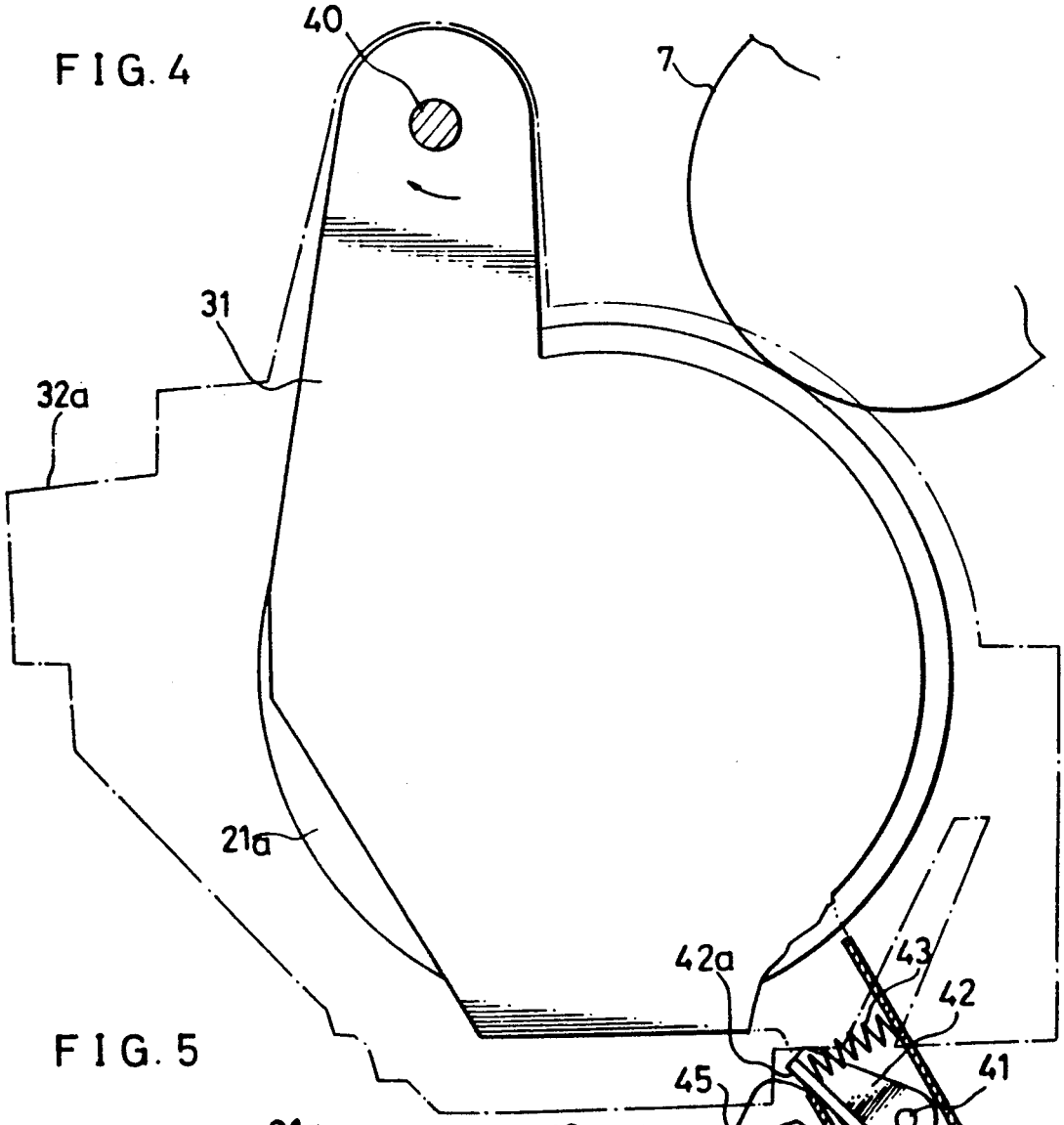
FIG. 4 is a front view of the transfer unit.
Figure 5:
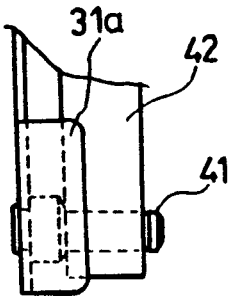
FIG. 5 is a fragmentary side view of the transfer unit.

The inner frame 31 has an upper portion into which a shaft 40 is attached as shown in FIG. 4, whereby the inner frame 31 is rotatable around the shaft 40, which itself is fixed to a main body frame 39 (shown in FIG. 2). A regulator 31*a* projecting inward is provided in lower portions of each of the front and rear ends of the inner frame 31 as shown in FIG. 5. A plate cam 42, rotatably on a pin 41 is provided adjacent to each of the regulators 31*a*. Each plate cam 42 has a cam surface 42*a*. A spring 43 impelling the plate cam 42 (counterclockwise in FIG. 4) is provided between the upper end of each plate cam 42 and the inner frame 31.

The regulating mechanism 33 will now be described.

Referring to FIG. 3, first and second rotating shafts 45 and 46 are rotatably mounted in the outer frame 32. The rotating shafts 45 and 46 are disposed in parallel with the drum shaft 36, and under the transfer drum 21. A pressing cam 47 is fixed by a spring pin 48 in a position opposite to each of the front and rear plate cams 42 associated with the first rotating shaft 45. Each pressing cam 47 is sectoral in shape as shown in FIG. 4, and has an outer surface 47*a* which comes into contact with the cam surface 42*a* of the corresponding plate cam 42.

Figure 6A:
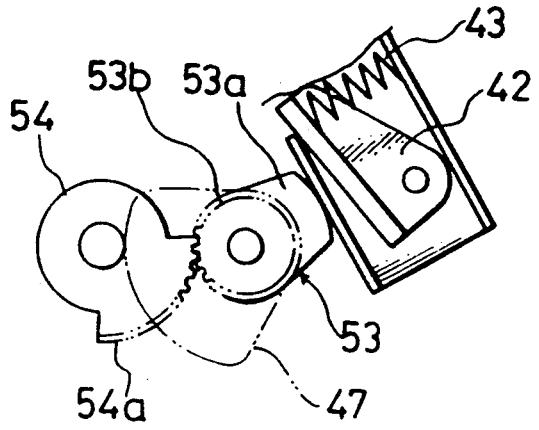
FIGS. 6A and 6B are fragmentary front views pertaining to operational states of the transfer unit.
Figure 6B:
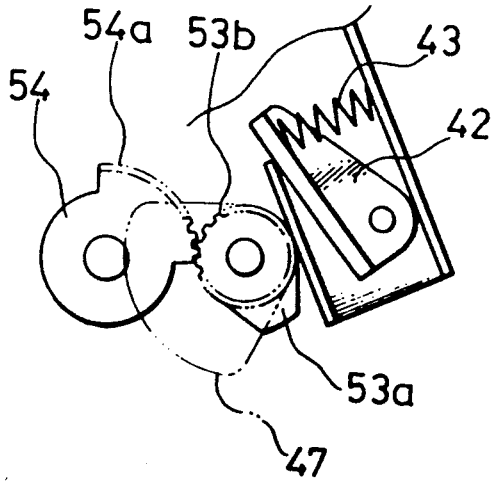

A coupling 49 is fixed to the rear end (on the right in FIG. 3) of the first rotating shaft 45. The coupling 49 is coupled to a driving system by means of a coupling 51 and a spring pin 52 at one end of a drive shaft 50 connected to the driving system, and by means of a spring 29, as shown in FIG. 2. A spring clutch and related elements are provided at the other end of the drive shaft 50, not shown, and the driving shaft 50 is rotated through 180° under the on/off operation of a solenoid, not shown. Accordingly, each pressing cam 47 is rotatable between a pressing position, as shown in FIG. 4, and a disengaging position, as shown in FIGS. 6A and 6B.

A regulating cam 53 is provided adjacent to each of the front and rear pressing cams 47. The regulating cams 53 are rotatably attached to the first rotating shaft 45 such that they can rotate independently of the pressing cams 47 and the first rotating shaft 45. Each of the regulating cams 53 has a contact tab 53*a* projecting outward as shown in FIG. 4, and a gear portion 53*b* is formed integrally with the contact tab 53*a*, and opposite to the contact portion 53*a*.

Figure 7:
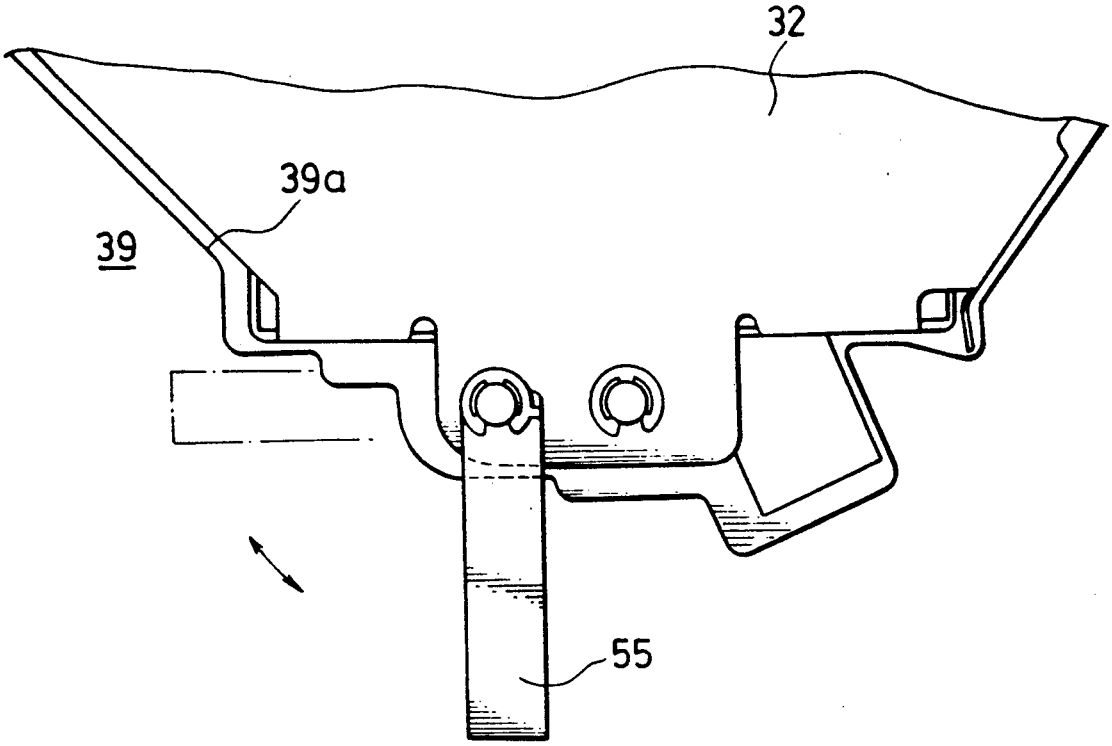
FIG. 7 is a fragmentary front view of a feature of the transfer unit.

A gear 54 is fixed so as not to rotate onto each end of the second rotating shaft 46, and a gear portion 54*a* is formed in an outer section of each gear 54. The gear portions 54*a* of the gears 54 engage with the gear portions 53*b* of the regulating cams 53. A disengaging lever 55 as shown in FIG. 7 is fixed to the front end of the second rotating shaft 46. The disengaging lever 55 is worked in order to remove the transfer unit 30 from the copying machine body 1. By switching the disengaging lever 55 from the position shown by solid lines in FIG. 7 to the position indicated by partially dotted lines, each regulating cam 53 is rotated through the gear 54 from the regulative position as indicated in FIG. 6A to the disengaging position as indicated in FIG. 6B.

Figure 8A:
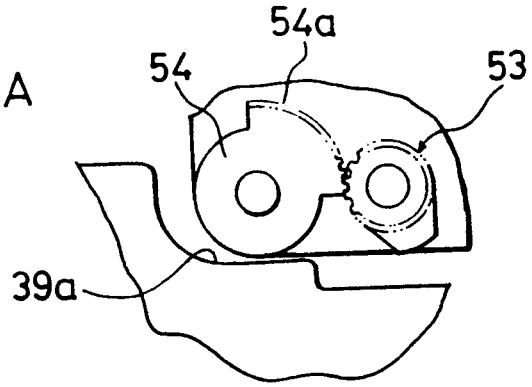
FIGS. 8A and 8B are views pertaining to mounting and dismounting of the transfer unit.

The main body frame 39 has an opening 39*a* through which the transfer drum 21, together with the inner and outer frames 31 and 32, is removed outside the apparatus. When the disengaging lever 55 is in the disengaging position, the gear portions 54*a* of the gears 54 are rotated upward as shown in FIG. 8A, so as not to interfere with the main body frame 39 when the transfer drum 21 is inserted into and removed from the copying machine body 1. When the disengaging lever 55 is in the engaged position, the gear portions 54*a* of the gears 54 are rotated downward, whereby the gear portions 54*a* catch against the main body frame 39, thereby forbidding insertion or removal of the transfer drum 21.

Figure 9:
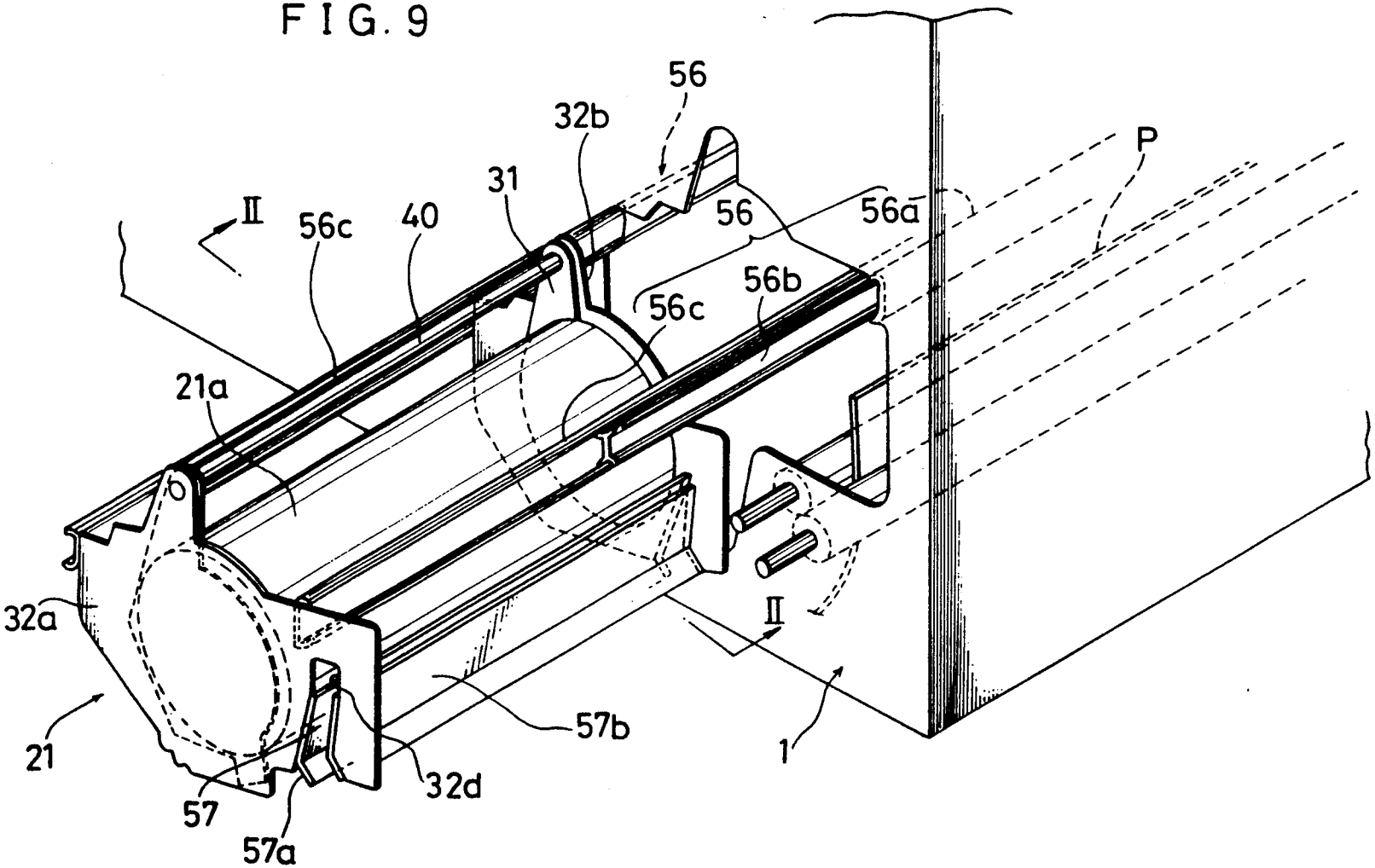
FIG. 9 is a perspective view of the transfer unit dismounted from the copying machine body.

The transfer unit 30 is guided by means of a pair of linear trundle bearings 56 provided along its right and left sides, as shown in FIG. 9, enabling it to be drawn out in front of the copying machine body 1. Each linear trundle bearing 56 comprises a first member 56*a* fixed to the copying machine body 1, a bearing member 56*b* slidable in the first member 56*a*, and a second member 56*c* slidably supporting the bearing member 56*b* and fixed to the front and rear side walls 32*a* and 32*b* of the outer frame 32.

Figure 10:
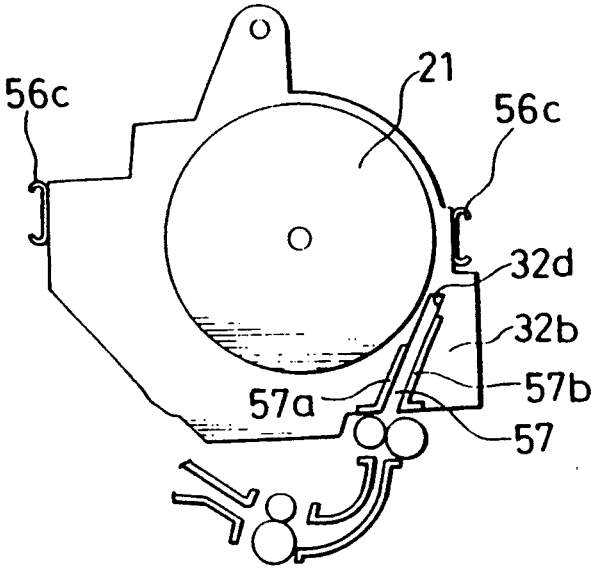
FIG. 10 is a schematic sectional view of the transfer unit mounted in the copying machine body.

As shown in FIGS. 9 and 10, a guide path 57 is provided in the sheet entrance of the transfer drum 21 for the supply of printing sheet thereto. The guide path 57 comprises a pair of guide plates 57*a* and 57*b* facing to each other at a predetermined spacing. The front edges of the guide plates 57*a* and 57*b* are fixed to the front side wall 32*a*, and the rear edges thereof are fixed to the rear side wall 32*b*. Each of the side walls 32*a* and 32*b* has a slit 32*d*, cutout from a portion of the lower edge of the side wall 32*a* or 32*b* to a predetermined length and corresponding to the front or rear side of the guide path 57 as defined by the respective edges of the guide plates 57*a* and 57*b*.

The operation will be described in the following.

When an original is placed on the original retainer 2 and a print key is pressed, a printing sheet is fed from the feed cassette 5 to the transfer drum 21. The reader 23 scans the original on the original retainer 2, whereupon information read by the reader 23 is transmitted to the laser unit 22. The beam of the laser unit 22 irradiates the photoconductor drum 7 in correspondence with the image information, whereby an electrostatic latent image in accordance with the image information is formed on the photoconductor drum 7. Subsequently, an image of each color is developed by each of the respective developing units 10 through 13, and is transferred onto the printing sheet on the transfer drum 21. If the printing sheet size is small, each of the images developed by the developing units 10 through 13 is transferred onto the printing sheet through one rotation of the transfer drum 21, so that the transfer operation is completed in four rotations of the transfer drum 21. Then, the printing sheet having the transferred image is separated from the transfer drum 21 by means of the separation claw 28, and is transported to the fixing unit 27 through the discharged sheet transport path 26. The printing sheet having the image fixed by the fixing unit 27 is discharged onto the copy tray 4.

If the size of the printing sheet is large, e.g., size A3, the printing sheet will be wound around nearly the entire circumference of the transfer drum 21. In this case, an image of one color is transferred onto the transfer drum 21 by one rotation of the drum 21, then the drum 21 idles for another rotation, during which no transferal occurs. During the idle rotation, the respective components are moved into predetermined positions, so as to be prepared for the transfer of an image of another color through the subsequent rotation. The image of the subsequent color is transferred during the rotation subsequent to the idle rotation.

Thus, if the printing sheet is large, there will be idle phases in the operation of the transfer drum. This case will be more specifically described.

During the image transfer stage, the pressing cams 47 are positioned as shown in FIG. 4, with each cam surface 47*a* thereof pressed against the cam surface 42*a* of the corresponding plate cam 42. As a result, the inner frame 31 of the transfer drum 21 is impelled counterclockwise around the shaft 40 by means of the springs 43, whereby the transfer drum 21 is pressed against the photoconductor drum 7. In this state, the image on the photoconductor drum 7 is transferred onto the printing sheet wound on the transfer drum 21.

After one rotation of the transfer drum 21, whereupon the image has been transferred, the solenoid of the driving system (not shown) is activated, thereby rotating the first rotating shaft 45 by 180° by means of the drive shaft 50, couplings 51 and 49, and related elements. The pressing cams 47 thus rotate by 180°, from the position shown in FIG. 4 to the position shown in FIG. 6A. As a result, the pressing action of the pressing cams 47 is released, whereby the inner frame 31 supporting the transfer drum 21 rotates clockwise around the shaft 40 under the weight of both the transfer drum 21 itself and its associated elements. When the transfer drum 21 is separated from the photoconductor drum 7 by a predetermined distance, the regulating portions 31*a* of the inner frame 31 come into contact with the projecting portions 53*a* of the regulating cams 53, whereby the transfer drum 21 is checked.

This condition is indicated by FIG. 6A. In the checked state, the gear portion 7*a* of the photoconductor drum 7 remains halfway engaged with the gear portion 35*b* of the transfer drum 21, and the drive force of the photoconductor drum 7 is transmitted to the transfer drum 21, whereby the transfer drum 21 is kept rotating. The transfer drum 21 thus idles, being halfway engaged with the photoconductor drum 7. While the transfer drum 21 is idling, among other operations the reader 23 returns to the home position, and a given developing unit among the units 10 to 13 is conveyed to a developing position.

In order to transfer an image of a subsequently developed color, the solenoid of the driving system is deactivated, whereby the first rotating shaft 45 rotates by 180° by means of the drive shaft 50, couplings 51 and 49 and associated elements, in the same manner as described above. As a result, the pressing cams 47 are rotated from the position shown in FIG. 6A to the pressing position as shown in FIG. 4, whereby the inner frame 31 rotates counterclockwise around the supporting shaft 40 through agency of the plate cams 42 and springs 43, thus pressing the transfer drum 21 against the photoconductor drum 7. In this state, the image developed in the subsequent color is transferred onto the printing sheet.

The above-described operation is repeated in order to transfer the respective color images onto the printing sheet on the transfer drum 21, which is idled during the intervals in which the developer colors are switched.

The removal of the transfer drum 21 together with the frames 31 and 32 from the copying machine body 1 will be described.

The disengaging lever 55 is rotated counterclockwise by 90° from the position indicated by partially dotted lines in FIG. 7 to the position shown by solid lines. Consequently, the gear members 54 move from the position shown in FIGS. 6A and 8B to the position shown in FIGS. 6B and 8A. Since the gear portion 54*a* of each gear 54 engages with the gear portion 53*b* of the corresponding regulating cam 53, the regulating cams 53 rotate essentially by 90°, from the regulating position shown in FIG. 6A to the disengaging position shown in FIG. 6B, as a result of the rotation of the gears 54. In consequence, the regulating portions 31*a* of the inner frame 31 disengage from the projecting portions 53*a* of the regulating cams 53, and the inner frame 31 rotates clockwise under its own weight. The transfer drum 21 is thus sufficiently separated from the photoconductor drum 7.

With the disengaging lever 55 in the dismounting position, the gears 54 are in the position shown in FIG. 8A. The gears 54 thus cannot catch on the main body frame 39, and the transfer unit 30 can be smoothly removed outside the copying machine body 1. Since the transfer drum 21 is substantially separated from the photoconductor drum 7, the drums 7 and 21 will not hit against each other and are protected from undergoing damage when the transfer unit 30 is removed from the body 1.

Figure 11:
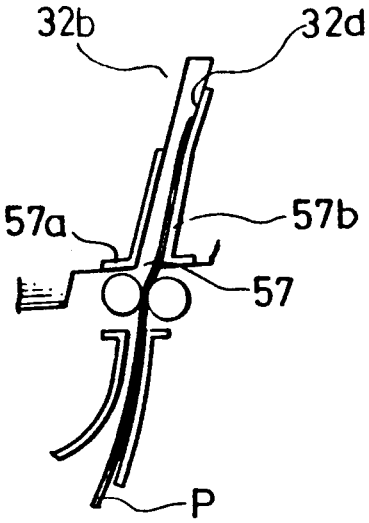
FIG. 11 is an enlarged fragmentary view of the transfer unit wherein a paper jam has occurred.

If a paper jam should occur while a printing sheet P passes through the guide path 57 between the guide plates 57*a* and 57*b* as shown in FIG. 11, the transfer unit 30 should be removed from the copying machine body 1 in order to remedy the paper jam. In the case shown, the printing sheet P has been nipped by transport rollers of the copying machine body 1, and should the operator try to remove the printing sheet P together with the unit 30, it might become torn, further encumbering the situation. However, in this machine the slit 32*d* provided in the rear side wall 32*b* permits the transfer unit 30 to pass over the printing sheet P unhindered when the unit is to be removed. Thus, the printing sheet P does not get caught in the rear side wall 32*b* and the jam is more easily remedied after the transfer unit 30 has been removed from the machine body 1.

In order to mount the transfer drum 21 together with the frames 31 and 32 into the copying machine body 1, the transfer drum 21 is pushed into the body 1 while the disengaging lever 55 is in the dismounting position shown by the solid lines in FIG. 7. As a result, the transfer drum 21 together with the frames 31 and 32 are mounted into the machine body 1 via the linear trundle bearings 56 in the order opposite to that described above. In this case also, the transfer drum 21 remains at a sufficient separation from the photoconductor drum 7, and accordingly the drums 21 and 7 cannot bump against each other and are protected from damage. When the disengaging lever 55 is located to the mounting position shown by the partially dotted lines in FIG. 7, the regulating cams 53 are rotated by means of the gears 54. Consequently, the projecting portions 53*a* of the regulating cams 53 push against the regulating portions 31*a* of the front and rear ends of the inner frame 31, whereby the transfer drum 21 nears the photoconductor drum 7. In this state, when a print button (not shown) is pressed, the first rotating shaft 45 rotates by 180°, whereby the pressing cams 47 rotate, and through the agency of the plate cams 42 and springs 43 the transfer drum 21 is pressed against the photoconductor drum 7. Thereafter, the copying operation as described above is performed.

Figure 8B:
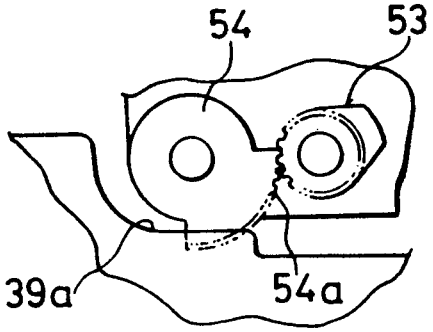

Should an operator inadvertently attempt to draw out the disengaging lever 55 when in the mount position (indicated by the partially dotted lines in FIG. 7) in an instance of dismounting the transfer drum 21, the gears 54 will be in the position shown in FIG. 8B, and the gear portions 54*a* of the gears 54 will act as catches on the main frame 39, whereby withdrawal of the transfer drum 21 is prevented. Thus, dismounting of the transfer drum 21 while it is either in contact with the photoconductor drum 7, or while the transfer drum 21 idles in a position close to the drum 7 is prevented. Consequently, the possibility of damage to the drums 7 and 21 due to inadvertent handling is prevented.

In this embodiment, the transfer drum 21 is pressed against the photoconductor drum 7 by means of the plate cams 42 and springs 43 associated with the pressing cams 47 provided in both the front and rear portions of the machine. Consequently, the pressing force of the transfer drum 21 against the photoconductor drum 7 is uniform along the direction from the front to the rear of the machine, thus ensuring that a good quality transferred image is obtained. When the transfer drum 21 idles, its position is controlled by the regulating cams 53 provided in both the front and rear of the machine, and thus the gap between the photoconductor drum 7 and the transfer drum 21 is uniform in the front and rear of the machine. Consequently, it is possible to reduce the backlash in the gear portions driving the transfer drum 21 over that of conventional machines, thereby preventing deviation of the color images.

While it is idling, the transfer drum 21 together with the frames 31 and 32 tend downward under their own weight and are supported entirely by the regulating cams 53, thus the frames distort only slightly, in comparison with the mechanism of conventional machines, in which the transfer drum is separated from the photoconductor drum by means of cams which oppose to the impelling force of springs. The gap between the photoconductor drum 7 and the transfer drum 21 running idle is made uniform in the front and rear portions of the machine, thus reducing the possibility of backlash in the gear portions driving the transfer drum 21, and preventing deviation of the color images.

In order to dismount the transfer drum 21 from the body 1, the transfer drum 21 can be sufficiently separated from the photoconductor drum 7 only by working the disengaging lever 55, whereupon the transfer drum 21 can be easily dismounted from the drum 7. The transfer drum 21 is prevented from being dismounted by the predetermined position of the disengaging lever 55, and the possibility of damage to the transfer drum 21 and the photoconductor drum 7 due to erroneous operation of the lever 55 is prevented.

If the transfer unit 30 must be removed from the body 1 while a printing sheet is jammed in the guide path 57, the paper jam can be easily remedied without damaging the jammed sheet since the slit 32*d* is provided in the rear side wall 32*b*.

Second Embodiment

FIGS. 12–16C illustrate a transfer unit according to the second embodiment of the invention. A copying machine incorporating the transfer unit of the second embodiment is the same as that shown by FIG. 1.

Figure 12:
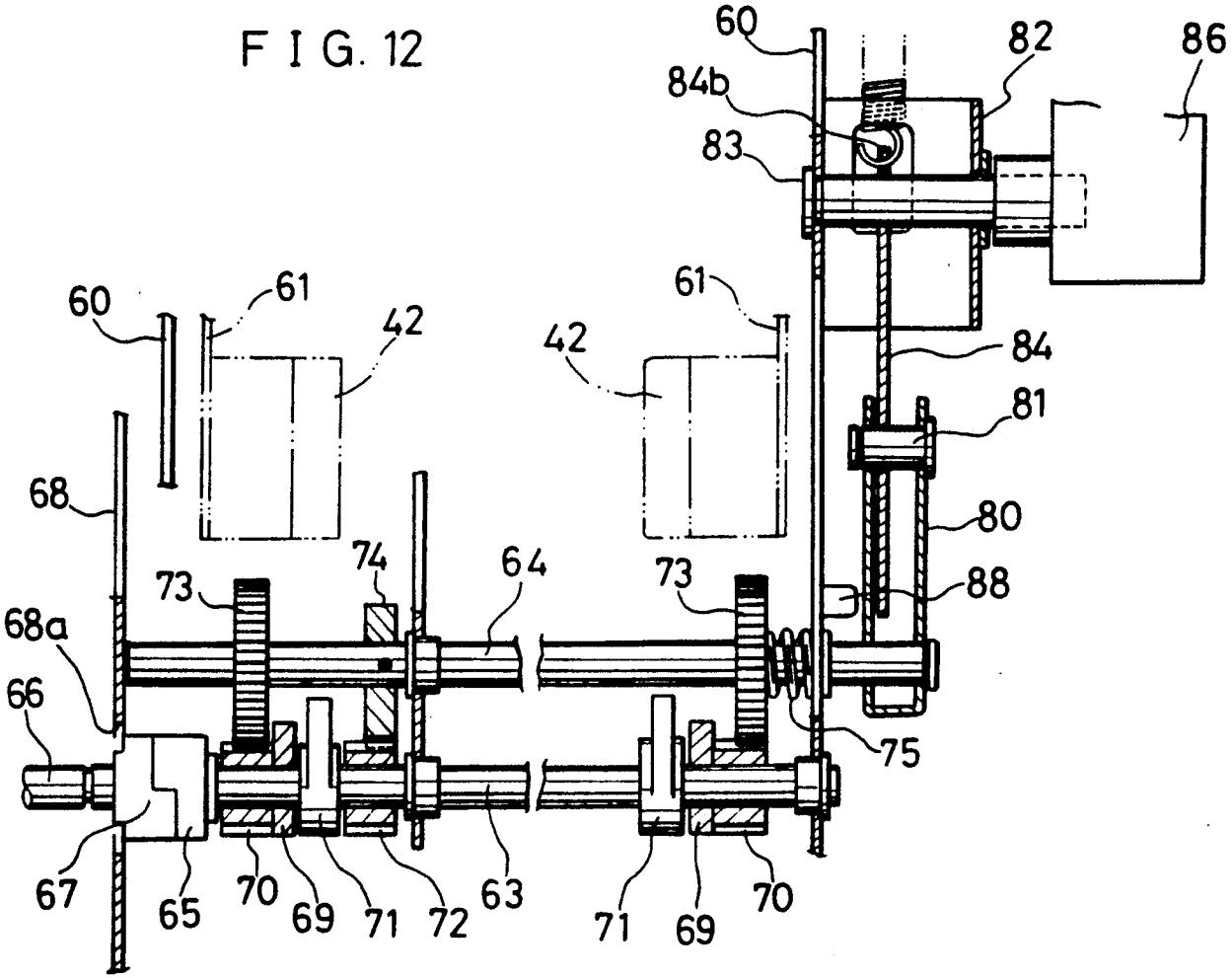
FIG. 12 is a fragmentary side view of the pressing and regulating mechanisms of a transfer unit according to a second embodiment of the invention, corresponding to FIG. 3 of the first embodiment.
Figure 13:
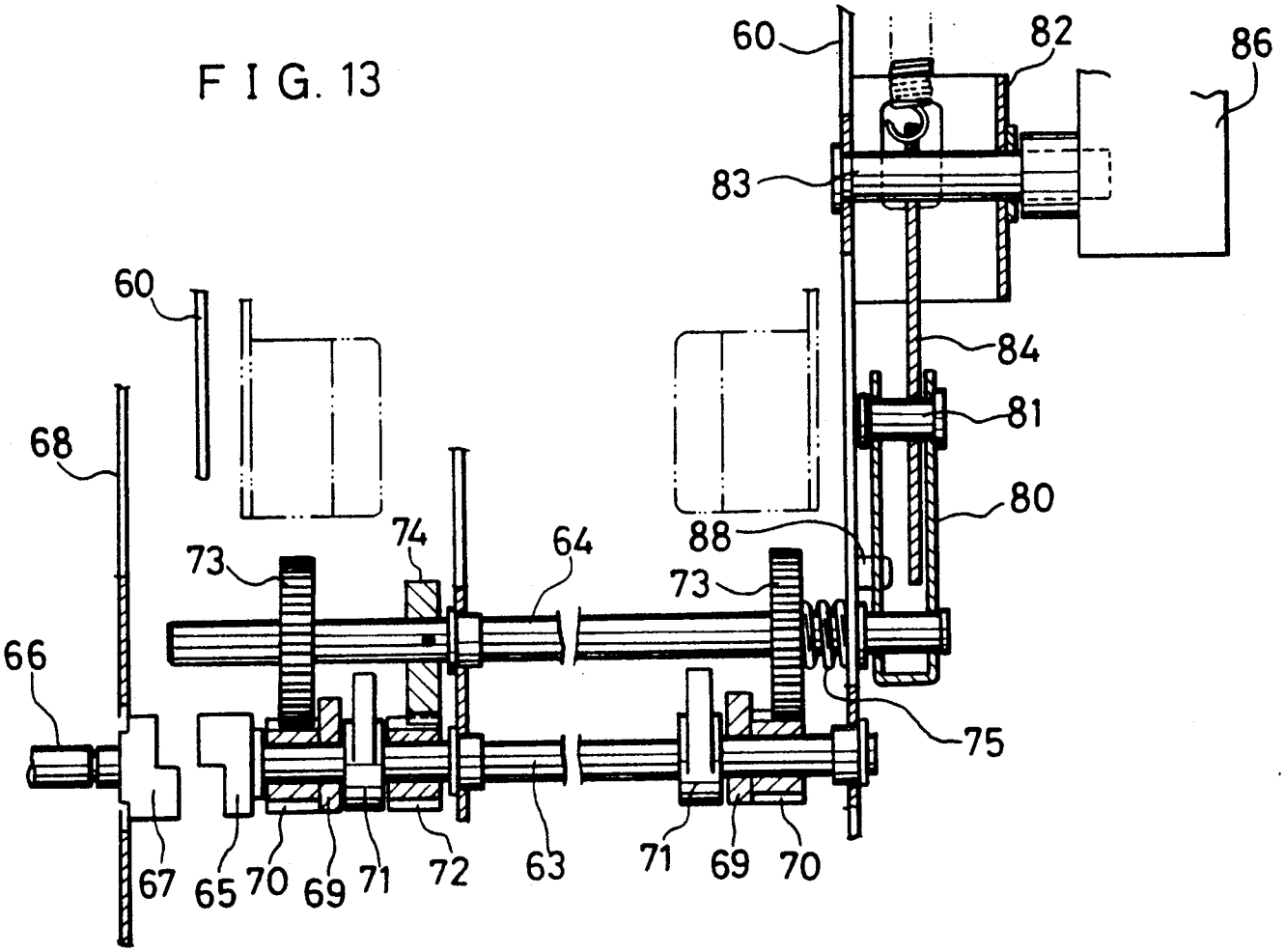
FIG. 13 is a view of these mechanisms of the transfer unit when dismounted.

FIGS. 12 and 13 show partly in section left side views of the machine. As is different from FIG. 2 illustrating the first embodiment, the right side in FIGS. 12 and 13 corresponds to the front of the machine, and the left side in these figures corresponds to the rear.

Figure 14:
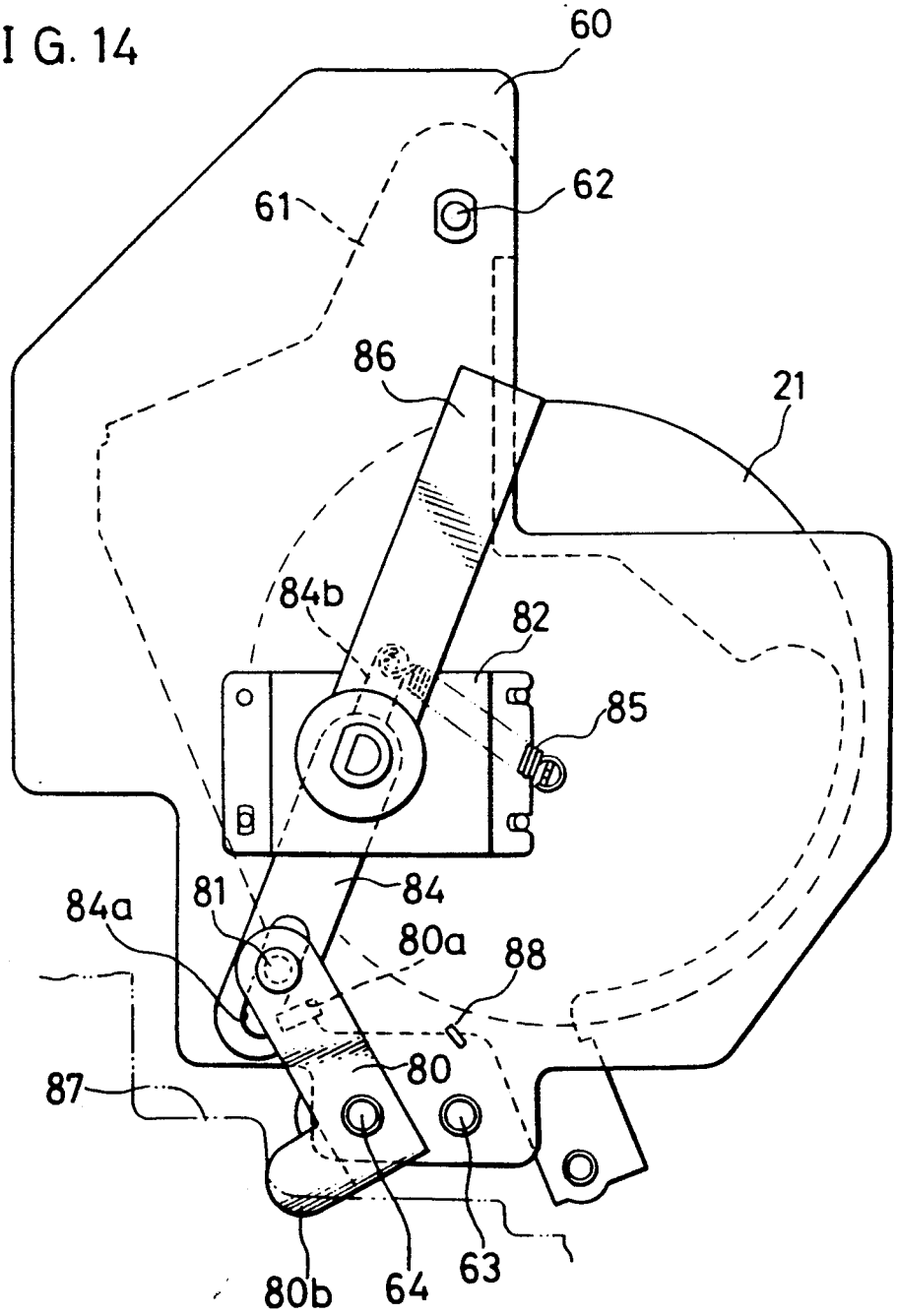
FIG. 14 is a front view of a feature of the transfer unit.

This transfer unit includes an outer (second) frame 60. An inner (first) frame 61 which supports a transfer drum is disposed within the outer frame 60. The inner frame 61 has upper portions rotatably connected to the outer frame 60, as shown in FIG. 14.

First and second rotating shafts 63 and 64 are rotatably attached to the outer frame 60. The rotating shafts 63 and 64 are disposed below the transfer drum 21, in parallel with the drum shaft. A coupling 65 is fixed at the rear end of the first rotating shaft 63. A drive shaft 66 is provided in the driving system of the copying machine body, and a coupling 67 connectable with the coupling 65 is fixed to the front end of the shaft 66. The coupling 67 projects toward the front of the machine through an opening 68*a* formed in a rear side plate 68 of the copying machine body 1.

Regulating cams 69 are provided on the front and rear ends of the first rotator shaft 63. Each regulating cam 69 is integrally formed with a projecting contact portion 69*a* and a gear 70. The cams 69 and the associated gears 70 are rotatably mounted on the first rotator shaft 63. Presser cams 71 are provided in the unit adjacent to the respective regulator cams 69. Each presser cam 71 is sectoral in shape as in the first embodiment, and is fixed to the first rotator shaft 63 so as to rotate together with it. A first disengaging gear 72 is provided adjacent to the presser cam 71 in the rear of the machine and is fixed to the rotating shaft 63. Each regulator cam 69 is disposed such that it can come into contact with a corresponding regulative portion of the inner frame 61, and the presser cam 71 is disposed such that it likewise can contact the corresponding plate cam 42, in the same manner as in the first embodiment.

The second rotator shaft 64 is provided with gears 73 which are fixed to the front and rear ends of the shaft 64 and are engaged with the gears 70 so as to drive the regulator cams 69. A second disengaging gear 74 which engages with the corresponding first disengaging gear 72 is fixed to the second rotator shaft 64. The second rotator shaft 64 is supported so as to be movable widthwise and rotatable with respect to the outer frame 60. A spring 75 which impels the second rotating shaft 64 toward the rear of the machine and is disposed between the inner wall of the outer frame 60 in the front of the machine and the facing end of the front gear 73. Consequently, when the transfer unit is mounted in the copying machine body as shown in FIG. 12, the coupling 65 on the rear end of the first rotating shaft 63 engages with the drive coupling 67, and the rear end of the second rotating shaft 64 is pushed against the rear side plate 68 of the machine body. Thus, the second rotating shaft 64 is pressed toward the front of the machine in opposition to the impelling force of the spring 75.

A rotatory bracket 80, formed as a U in vertical cross section, is fixed onto the front end of the second rotating shaft 64. A pin 81 is provided extending through both upper branches of the U-shaped rotatory bracket 80. The portion of the bracket 80 nearer to the outer frame 60 has a hole 80*a* under the pin 81, as shown in FIG. 14. A lever support bracket 82 is fixed onto the frontward surface of the outer frame 60. The lever support bracket 82 is U-shaped in horizontal cross section, and a support pin 83 is inserted through its central portion. The support pin 83 extends from inside the outer frame 60 toward the front of the machine, and its front end projects from the lever support bracket 82. A rotatory plate 84 is fixed rigidly to the support pin 83. An elongate hole 84*a* is formed in a lower end portion of the rotatory plate 84, and the pin 81 passes therethrough.

In the above-described structure, the second rotating plate 84 rotates together with the support pin 83, and the rotatory plate 80 linked thereto by means of the pin 81 through the hole 84*a* and also rotates, thereby rotating the second rotating shaft 64. A projecting tab 84*b* is formed on the upper portion of the rotatory plate 84, and a return spring 85 for bringing the rotatory plate 84 to its initial position is provided between the projection 84*b* and the outer frame 60. A lever 86 is attached to the front projecting portion of the support pin 83, through the agency of which the second rotating shaft 64 can be rotated.

Figure 15:
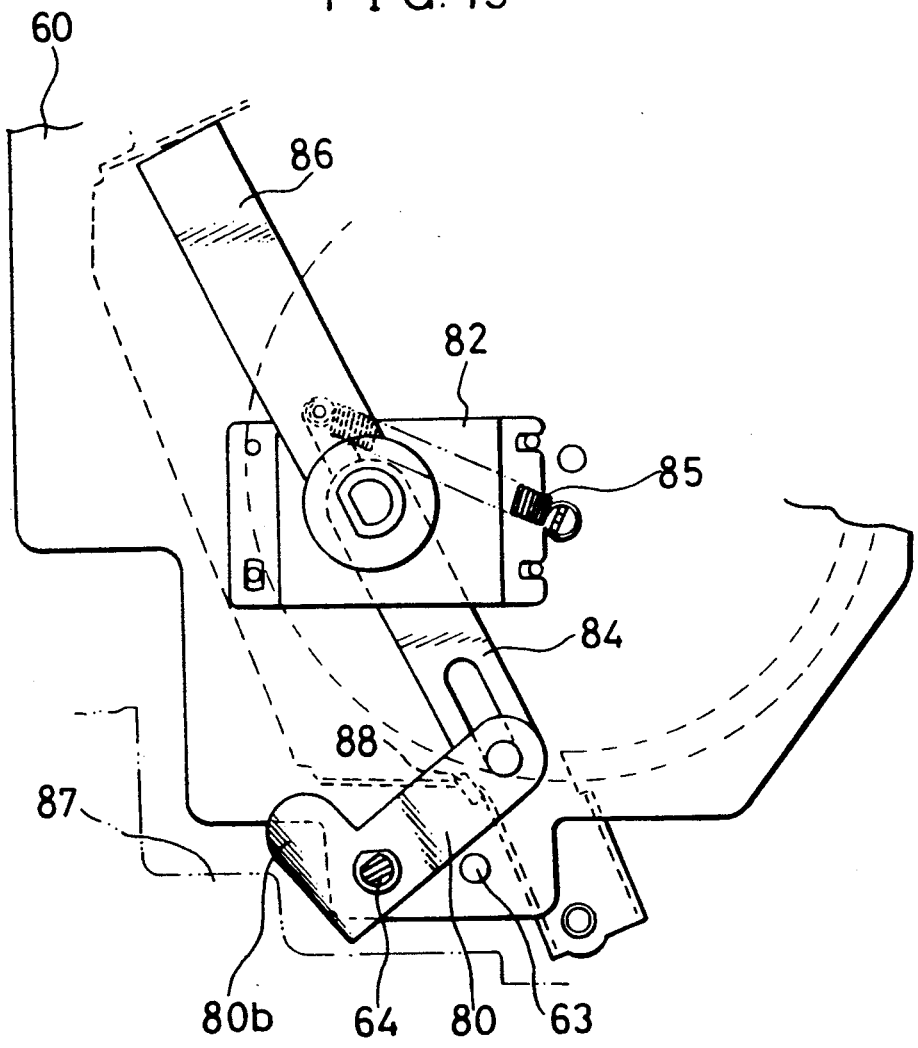
FIG. 15 is a fragmentary front view pertaining to the mounting and dismounting of the transfer unit of the second embodiment.

FIG. 14 shows the state in which the lever 86 is in the mount position, and FIG. 15 shows the state in which the lever 86 is in the dismount position. As shown in FIG. 14, a projection 88 is formed in a central lower portion of the outer frame 60, so that when the lever is put into the dismount position, the hole 80*a* of the rotatory bracket 80 engages with the projection 88. A removal control tab 80*b* which projects in the width direction with respect to the rotatory plate 80 is formed in its lower portion. As can be seen from FIGS. 14 and 15, when the lever 86 is in the mount position as shown in FIG. 14, the removal control tab 80*b* is caught against the frame 87 of the machine body 1, whereby removal of the transfer drum 21 is prevented. Conversely, when the lever 86 is in the dismount position, the rotatory bracket 80 rotates by a predetermined angle, and the removal control tab 80*b* is apart from the frame 87 of the machine body 1, allowing the transfer drum 21 to be removed from the body 1.

Figure 16A:
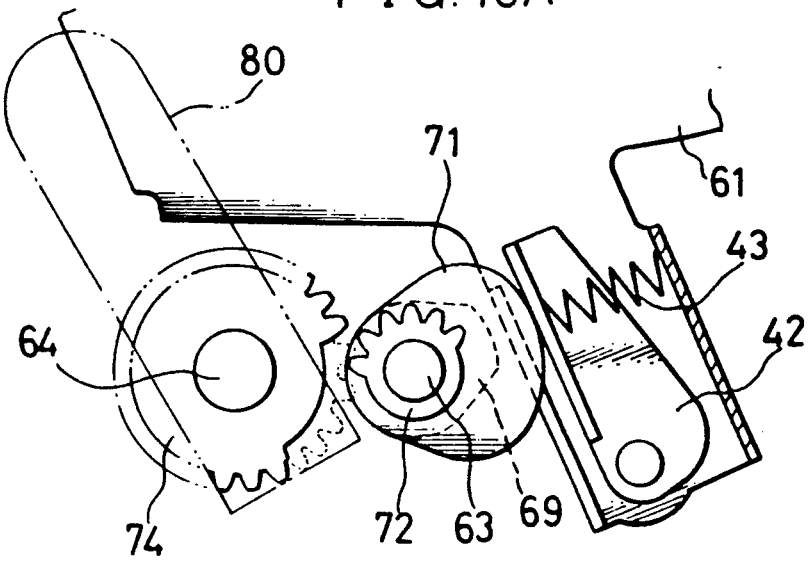
FIGS. 16A, 16B and 16C are fragmentary front views pertaining to the operation of the transfer unit of the second embodiment.
Figure 16B:
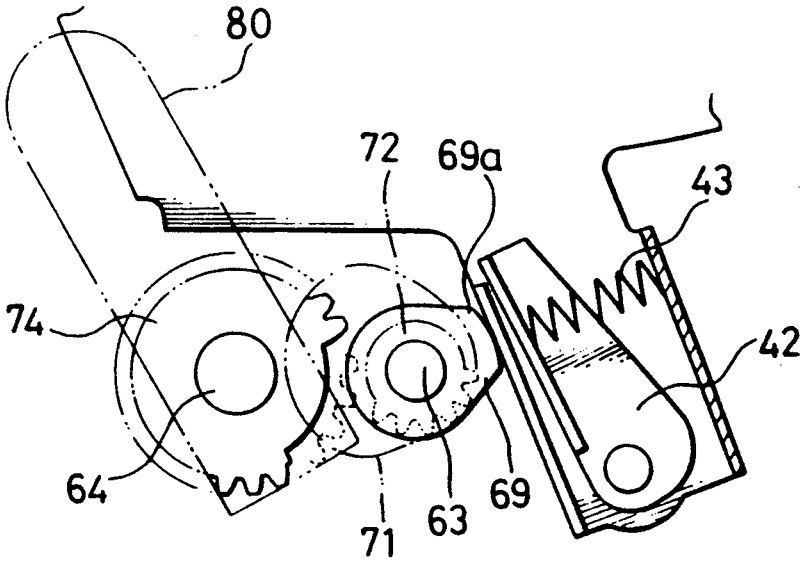

FIGS. 16A and 16B show engagement of the regulator cams 69, presser cams 71, and disengage gears 72 and 74 on the first and second rotating shafts 63 and 64. As shown in FIG. 16A, the first disengage gear 72 is only partially provided with teeth, and the second disengaging gear 74 has a gap in a portion of its outer circumference. Thus, the second rotator shaft 64 is not rotated by rotation of the first rotator shaft 63 and the first disengage gear 72 when the lever 86 is in the mount position at which the first rotator plate 80 is in the position as shown in FIG. 16A.

A plate cam 42, and a spring 43 impelling the cam 42 are provided in a lower portion of the inner frame 61 in the same manner as in the first embodiment.

The operation of the second embodiment will now be described.

The overall operation is performed in the same manner as in the first embodiment. Therefore, in the following the operation of the transfer unit will be specifically described.

When the transfer unit is mounted in the copying machine body, the coupling 65 on the rear end of the first rotating shaft 63 is coupled to the coupling 67 of the copying machine body 1. The rear end of the second rotating shaft 64 is pressed against the rear side plate 68 of the machine body 1, and is pressed toward the front in opposition to the impelling force of the spring 75. In this state, the projection 88 is disengaged from the hole 80*a* of the rotatory bracket 80, and the lever 86 is retained in the mounting position as shown in FIG. 14 by means of the return spring 85. The rotatory bracket 80 and rotatory plate 84 are also in the positions shown in FIG. 14. In this state, the removal control tab 80*b* of the lower end of the rotatory bracket 80 is stopped by the frame 87 of the machine body 1, whereby the transfer unit is prevented from being drawn out.

In this mounting position, when an image is to be transferred onto the printing sheet on the transfer drum 21 the regulating cams 69 and pressing cams 71 are in the positions as shown in FIG. 16A, wherein the presser cams 71 press against the cam surfaces 42*a* of the associated plate cams 42. Consequently, the inner frame 61 of the transfer drum 21 is driven counterclockwise around the shaft 62 by agency of the spring 43, whereby the transfer drum 21 is pressed against the photoconductor drum 7. In this state, the image on the photoconductor drum 7 is transferred onto the printing sheet wound on the transfer drum 21.

After one rotation of the transfer drum 21, the solenoid of the driving system is activated, whereby the first rotating shaft 63 is rotated 180° through the drive shaft 66 and couplings 67 and 65. The pressing cams 71 rotate 180° thereby from the position shown in FIG. 16A to the disengage position shown in FIG. 16B. As a result, the pressing action of the presser cams 71 is released, and the inner frame 61 supporting the transfer drum 21 rotates clockwise around the shaft 62 under the weight of the transfer drum 21 and the related elements. Subsequently, the regulative portion of the inner frame 61 is stopped by the projecting portion 69*a* of the regulating cam 69 at a position wherein the transfer drum 21 is separated from the photoconductor drum 7 by a predetermined distance and is prevented from moving further.

In consequence, the gear portion 7*a* of the photoconductor 7 and the gear portion 35*b* of the transfer drum 21 become halfway engaged with each other, and the drive force from the photoconductor drum 7 continues to be transmitted to the transfer drum 21, which thus continues to rotate.

The transfer unit can be removed from the machine body 1 in the manner as described below. In order to remove the transfer unit, the lever 86 is rotated counterclockwise into the dismounting position as shown in FIG. 15, whereupon the rotatory plate 80 rotates clockwise and the removal control tab 80*b* moves upward. Consequently, the removal control tab 80*b* is no longer caught against the frame 87, and the transfer unit may be drawn out. In this state, when the lever 86 is drawn out frontward, the first rotating shaft 63 becomes detached from the driving system as shown in FIG. 13. The rear end of the second rotator shaft 64 becomes separated from the rear side plate 68 of the body 1, and the shaft 64 is pushed rearward by the impelling force of the spring 75, which meanwhile draws the rotatory plate 80 on the front end of the second rotating shaft 64 the rearward. As a result, the hole 80*a* of the rotatory bracket 80 becomes seated on the projection 88 of the outer frame 60. Thus, the lever 86 is kept in the dismount position against the tension of the return spring 85.

Figure 16C:
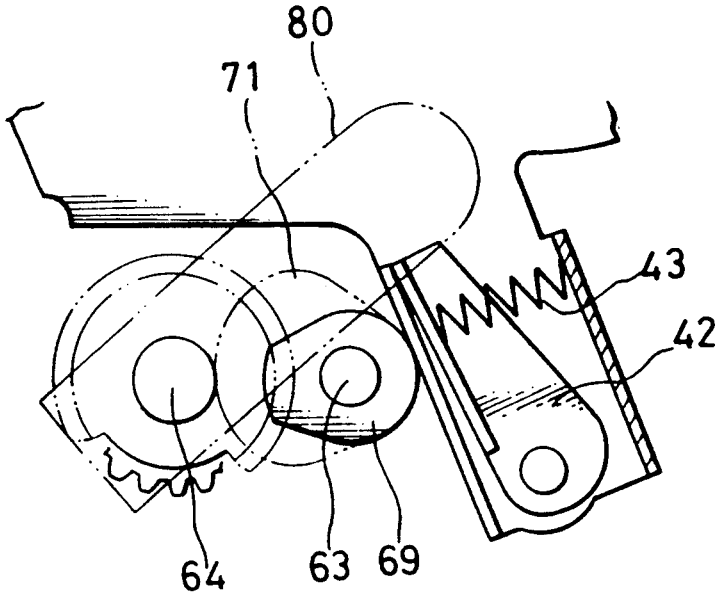

As a result of bringing the lever 86 into the dismount position, the second rotating shaft 64 is rotated through the rotatory plate 84 and the rotatory bracket 80. In consequence, the regulating cams 69 rotate essentially 180° by agency of the gears 73 and 70, according to their gear ratio, whereby the cams 69 are brought into the disengage position as shown in FIG. 16C. Thus, the regulating cams 69 disengage the inner frame 61, whereby the inner frame 61 rotates clockwise under its own weight, namely the weight of the transfer drum 21 and related elements. The transfer drum 21 is the sufficiently separated from the photoconductor drum 7 such that the entire transfer unit may be drawn out frontward of the machine, while guaranteeing that collision between the transfer drum 21 and the photoconductor drum 7 will be avoided.

In order to mount the transfer drum 21 together with the frames into the machine body 1, the lever 86, in the dismount position, is pushed toward the machine body 1. When the lever 86 reaches the predetermined position, the second rotating shaft 64 presses against the rear side plate 68 of the machine body 1, and is pushed frontward. Thereupon, the projection 88 disengages from the hole 80*a* of the rotatory bracket 80. As a result, the lever 86 is brought into the mount position by the return force of the return spring 85. The second rotating shaft 64 is simultaneously rotated by means of the rotatory bracket 80 and plate 84, and the regulator cams 69 are brought into the retaining position as shown in FIG. 16B by agency of the gears 73 and 70. Thus the transfer drum 21 is positioned close to the photoconductor drum 7.

A handling procedure in the instance of a paper jam will now be described.

Should a paper jam occur during a transfer operation, for which the regulating elements of the transfer unit will be positioned as shown in FIG. 16A, and the copying machine stops, the transfer drum 21 will be in the state in which it is pressed against the photoconductor drum 7. The lever 86 is then rotated to the dismount position for the purpose of remedying the jam. This brings the teeth of the second disengaging gear 74 into engagement with the teeth of the first disengaging gear 72, whereby the pressing cams 71 are rotated essentially 180° according to the gear ratio therein, and are swung into the disengaging position as shown in FIG. 16B. The regulating cams 69 are simultaneously brought into the disengaging position as shown in FIG. 16C by agency of the gears 73 and 70. Thus if the copying machine stops during a transfer operation, the transfer drum 21 can be sufficiently separated from the photoconductor drum 7 simply by operating the lever 86, whereby the transfer drum 21 may be reliably dismounted and the jammed sheet removed.

If a paper jam occurs during the idle running of the transfer drum 21, the copying machine stops in the state to which FIG. 16B correlates. When the lever 86 is rotated from the mount position to the dismount position, the regulating cams 69 rotate by agency of the gears 73 and 70. Meanwhile, the toothed portion of the first disengage gear 72 is turned downward as shown in FIG. 16B, whereby it cannot engage with the associated second disengage gear 74 even if the gear 74 were to rotate. Consequently, the pressing cams 71 are kept in the disengaging position as shown in FIG. 16B, to be finally brought into the position shown in FIG. 16C. Thus, the transfer drum 21 is sufficiently separated from the photoconductor drum 7, allowing the unit to be smoothly dismounted so that the jammed sheet can be removed.

While the transfer unit is either mounted into or dismounted from the image forming apparatus, the lever 86 is retained in the dismount position by the engagement of the projection 88 into the hole 80*a* of the rotatory bracket 80. Consequently, the cams 69 and 71 are also retained in the dismounting position as shown in FIG. 16C, whereby the transfer drum 21 is dependably secured from bumping against the photoconductor drum 7 when the transfer unit is dismounted.

When the transfer unit is mounted into the copying machine body 1, the lever 86 is automatically returned to the mounting position by agency of the return spring 85, and the cams 69 and 71 are retained in their rotating idle positions. As a result of these features, operational mishandling is dependably averted.

Third Embodiment

Figure 17:
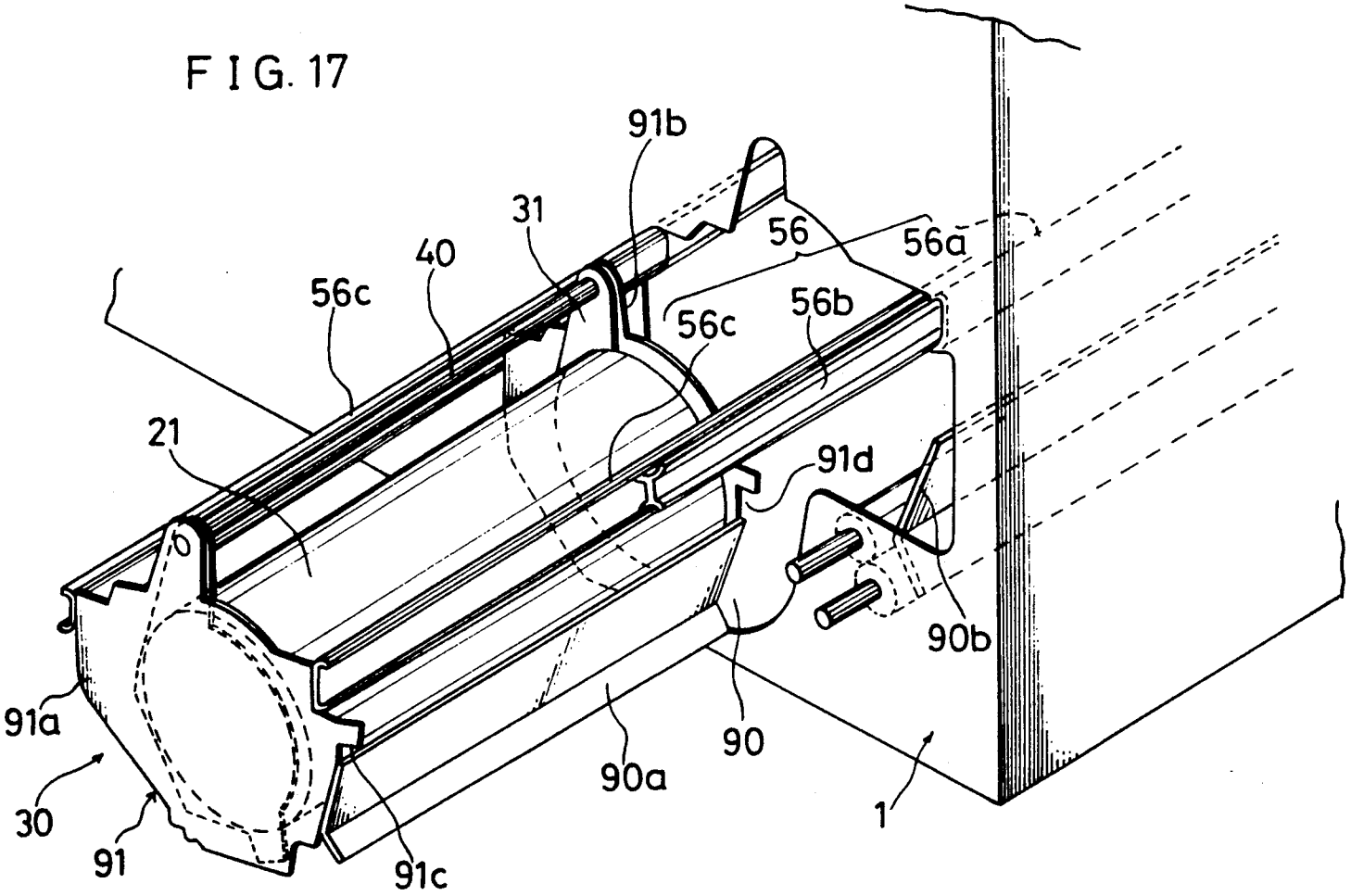
FIG. 17 is a perspective view of a dismounted transfer unit according to a third embodiment of the invention, corresponding to FIG. 9 of the first embodiment.
Figure 18:
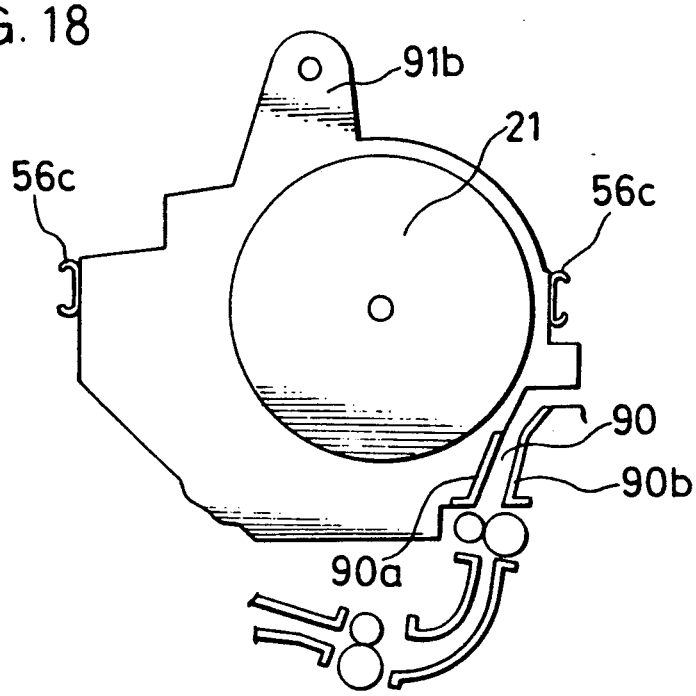
FIG. 18 is a schematic sectional view of the transfer unit of the third embodiment mounted in a copying machine body, corresponding to FIG. 10 of the first embodiment.
Figure 19:
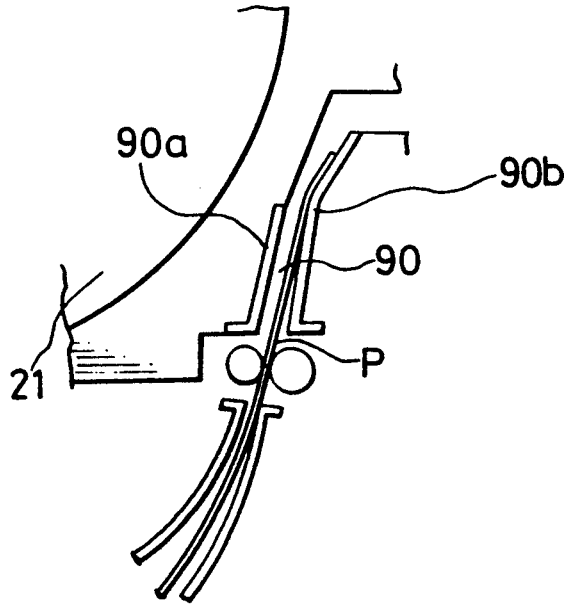
FIG. 19 is a fragmentary enlarged view of the transfer unit of the third embodiment wherein a paper jam has occurred.

FIGS. 17–19 illustrate the third embodiment, which includes a guide path and an outer frame different from those of the first embodiment.

Referring then to FIGS. 17 and 18, a guide path 90 for supplying a printing sheet to the transfer drum 21 extends into an inlet to the transfer drum 21. The guide path 90 is formed by a pair of guide plates 90*a* and 90*b* which face each other at a predetermined spacing. The guide plates 90*a* and 90*b* extend parallel to the drum shaft of the transfer drum 21. The guide plate 90*a*, nearer to the transfer drum 21, has its front and rear edges fixed to front and rear side walls 91*a* and 91*b* of an outer frame 91. The other guide plate 90*b* is fixed to the frame of the machine body 1. The front and rear side walls 91*a* and 91*b* of the outer frame 91 include cutouts 91*c* and 91*d* corresponding to the front and rear edges of the guide path 90.

If a printing sheet P becomes jammed in the guide path 90 as shown in FIG. 19 and the transfer unit is drawn out toward the front of the machine, the printing sheet P will not get caught nor be torn by the rear side wall 91*b*, since it can slide through the cutout. Thus, the paper jam can be remedied with greater facility.

In this embodiment, the front and rear side walls 91*a* and 91*b* include cutouts corresponding to the edges of the guide path 90. However, at least one such cutout included in the rear side wall 91*b* may be sufficient.

Fourth Embodiment

Figure 20:
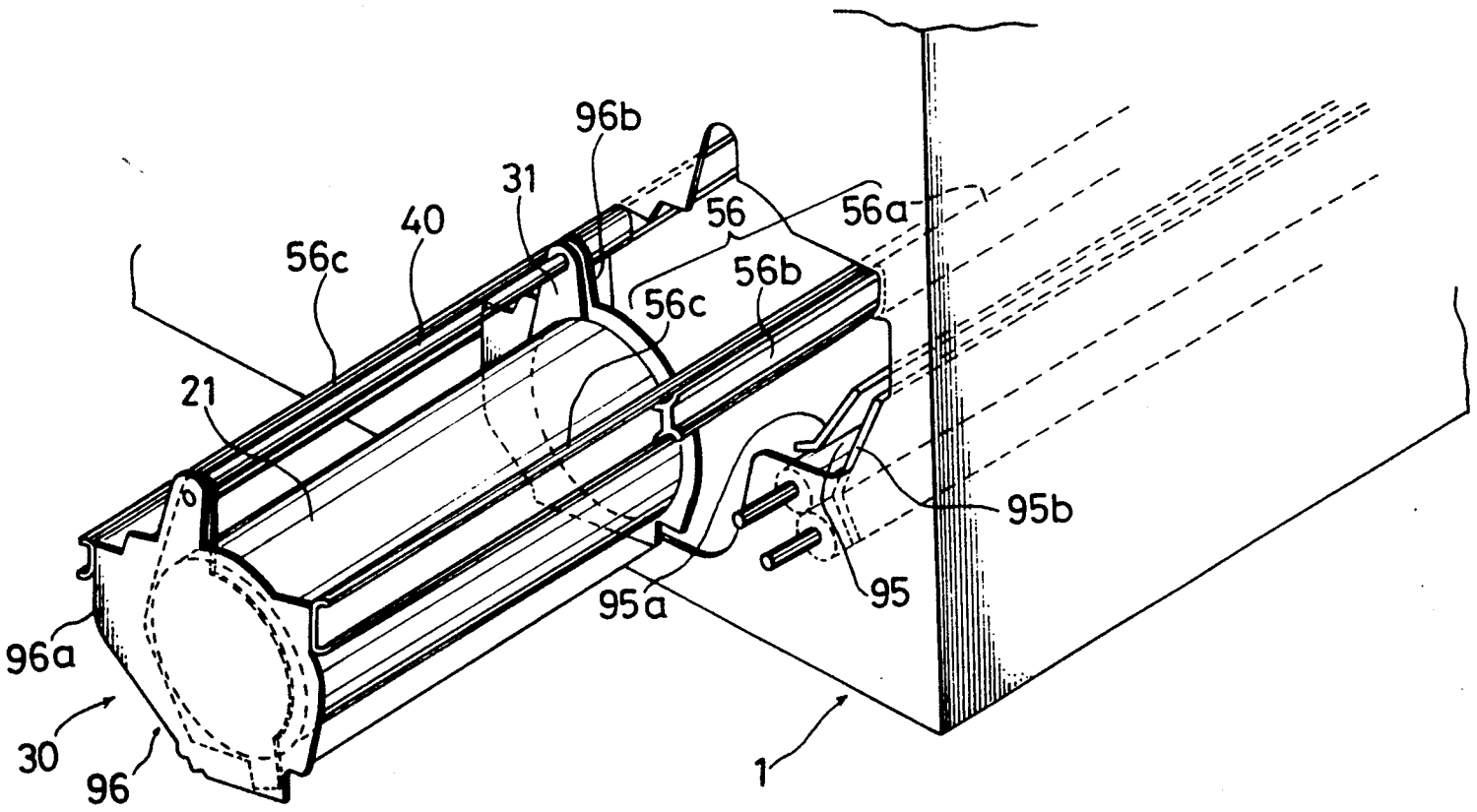
FIG. 20 is a perspective view of a dismounted transfer unit according to a fourth embodiment of the invention.
Figure 21:
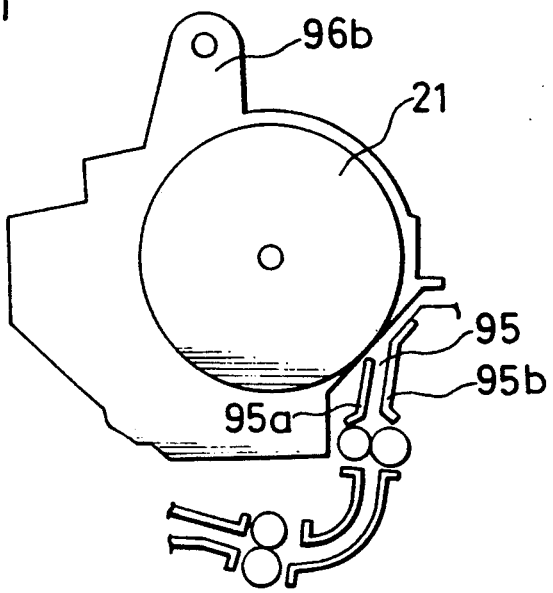
FIG. 21 is a schematic sectional view of the transfer unit of the fourth embodiment mounted in a copying machine body.
Figure 22:
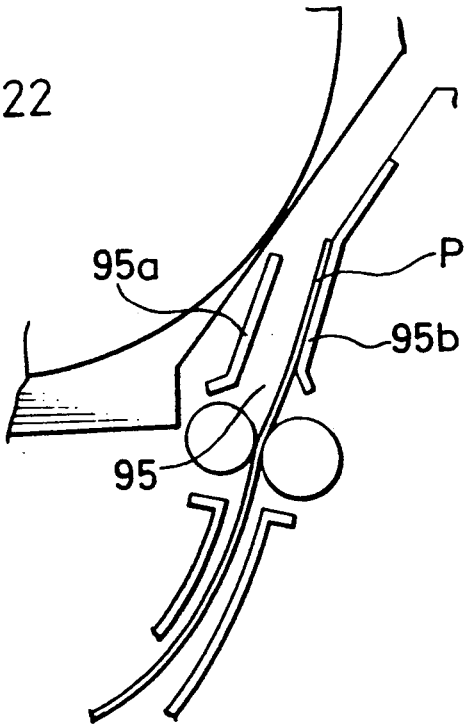
FIG. 22 is a fragmentary enlarged view of the transfer unit of the fourth embodiment wherein a paper jam has occurred.

FIGS. 20–22 illustrate the fourth embodiment, which includes a guide path and an outer frame different from those in the first and third embodiments.

Referring now to FIGS. 20 and 21, a guide path 95 for supplying a printing sheet to the transfer drum 21 extends into an inlet to the transfer drum 21. The guide path 95 is formed by a pair of guide plate 95*a* and 95*b* which face each other at a predetermined spacing. The guide plates 95*a* and 95*b* are disposed parallel to the drum shaft of the transfer drum 21, and are fixed to the frame of the machine body 1. Front and rear side walls 96*a* and 96*b* of an outer frame 96 of the transfer unit include cutouts which enable easy removal of the transfer unit.

In this case, if a printing sheet P becomes jammed in the guide path 95 as shown in FIG. 22 and the transfer unit is withdrawn, the printing sheet will not get caught by the transfer unit as it is drawn out, since the guide plates 95*a* and 95*b* are fixed to the copying machine body 1. The paper jam can thus be remedied easily.

In this embodiment, at least one such cutout included in the rear side wall 96*b* may be sufficient.

Modifications (a) In the first embodiment, the presser cams 47 are provided independently of the regulator cams 53. However, the presser cam 47 and the regulator cam 53 may be formed integrally as one cam.

(b) Although the pressor cams 47 and regulator cams 53 are provided in the front and rear of the machine in each of the above-described embodiments, these cams 47 and 53, and a mechanism corresponding to the regulative portions 31*a* and plate cams 42, may be provided, for example, in a central portion of the outer frame 32, with respect to its width direction.

(c) Although the transfer device is a transfer drum in each of the above-described embodiments, a present invention is also applicable to a structure in which the transfer device is composed of, for example, rollers, belts, and associated elements.

Various details of the invention may be changed without departing from its spirit nor its scope. Furthermore, the foregoing description of the embodiments according to the present invention is provided for the purpose of the illustration only, and not for the purpose of limiting the invention as defined by the appended claims and their equivalents.

What is claimed is:

1. A transfer unit of an image forming apparatus, comprising:

a transfer device disposed adjacent to a photoconductor of the image forming apparatus, and movable away from said photoconductor under its own weight;

means for pressing said transfer device against said photoconductor;

means for regulating a distance by which said transfer device is separated from said photoconductor when a pressing action of said pressing means is released;

wherein said pressing means and said regulating means are each disposed at both ends of said transfer device along its width direction;

a first frame supporting both ends of said transfer device, wherein said pressing means presses said transfer device against said photoconductor through means of said first frame; and a second frame rotatably supporting a portion of said first frame, wherein said pressing means includes a pressing cam rotatably supported by said second frame, a plate cam provided so as to be movable within said first frame and with which said pressing cam engages, and an elastic member provided between said plate cam and said first frame.

2. A transfer unit according to claim 1, wherein said regulating means includes a regulator cam rotatably supported by said second frame, and pressing against a portion of said first frame.

3. A transfer unit according to claim 2, wherein said regulating means functions to assume a regulative position, in which a first space is provided between said transfer device and said photoconductor, and a disengage position, in which a second space wider than said first space is provided between said transfer device and said photoconductor when the pressing action of said pressing means is released.

4. A transfer unit of an image forming apparatus, comprising:

a transfer device disposed adjacent to a photoconductor of the image forming apparatus, and movable away from said photoconductor under its own weight;

means for pressing said transfer device against said photoconductor;

means for regulating a distance by which said transfer device is separated from said photoconductor when a pressing action of said pressing means is released;

wherein said regulating means assumes a regulative position, in which a first space is provided between said transfer device and said photoconductor, and a disengage position, in which a second space wider than said first space is provided between said transfer device and said photoconductor when the pressing action of said pressing means is released;

wherein said transfer device of said transfer unit is removable from a main body of said image forming apparatus, said transfer unit further including:

manipulation means, movable between a mount position and a dismount position, for mounting said transfer device into and dismounting it from said image forming apparatus, said manipulation means including a rotary shaft; and means for coupling said manipulation means with said regulating means such that said regulating means is disposed in the regulative position when said manipulation means is in the mount position, and such that said regulating means is disposed in the disengage position when said manipulation means is in the dismount position.

5. A transfer unit according to claim 4, further comprising a first frame supporting both ends of said transfer device, and a second frame rotatably supporting a portion of said first frame, wherein said regulating means includes a regulator cam rotatably supported by said second frame, and pressing against said portion of said first frame, said manipulation means includes an operation lever, and said coupling means is a member which transmits a turning of said operation lever to said regulator cam.

6. A transfer unit according to claim 5, wherein said regulating means includes a presser cam rotatably supported by said second frame, and functioning to assume a pressing position, in which said transfer device is pressed against said photoconductor through means of said first frame, and a disengage position for releasing the pressing action, said transfer unit further including:

a first rotator shaft which rotates together with said presser cam;

a second rotator shaft which rotates together with said operation lever;

a first disengage gear, partially provided with teeth along its circumference and fixed to said first rotator shaft, which, by the turning of said operation lever from the mount position to the dismount position, brings said pressing cam from the pressing position into the disengage position, and which prevents said presser cam in the dismount position from being rotated by the turning of said operation lever from the mount position to the dismount position; and a second disengage gear engageable with said first disengage gear, and fixed to said second rotator shaft, said second disengage gear having a gap along a portion of its circumference, which thereby prevents said operation lever in the mount position from being rotated by a rotation of said first rotator shaft.

7. A transfer unit according to claim 4, further comprising means for returning said manipulation means to the mount position when said transfer device is mounted into said image forming apparatus.

8. A transfer unit according to claim 7, wherein said returning means is an elastic member for drawing said manipulation means into the mount position.

9. A transfer unit of an image forming apparatus, comprising:

a transfer device disposed adjacent to a photoconductor of the image forming apparatus, and movable away from said photoconductor under its own weight;

means for pressing said transfer device against said photoconductor;

means for regulating a distance by which said transfer device is separated from said photoconductor when a pressing action of said pressing means is released;

wherein said regulating means assumes a regulative position, in which a first space is provided between said transfer device and said photoconductor, and a disengage position, in which a second space wider than said first space is provided between said transfer device and said photoconductor when the pressing action of said pressing means is released; and control means for permitting said transfer device to be mounted into and dismounted from said image forming apparatus when said regulating means is in the disengage position, and for preventing the mounting and dismounting of said transfer device when said regulating means is in the regulative position.

10. A transfer unit of an image forming apparatus, comprising:

a transfer device disposed adjacent to a photoconductor of the image forming apparatus, and movable away from said photoconductor;

position control means for controlling positioning of said transfer device by assuming a first position for pressing said transfer device against said photoconductor, and a second position and a third position for spacing said transfer device from said photoconductor by a first distance and a greater second distance, respectively;

wherein said transfer device is removable from a main body of said image forming apparatus, said transfer unit further including:

manipulation means, movable between a mount position and a dismount position, for mounting said transfer device into and dismounting it from the main body of said image forming apparatus, and coupling means for coupling said manipulation means with said position control means, thereby compelling said position control means to assume the second position when said manipulation means is in the mount position, and to assume the third position when said manipulation means is in the dismount position.

11. A transfer unit according to claim 10, further comprising position retaining means for retaining said position control means in the third position.

12. A transfer unit according to claim 11, further comprising means for returning said manipulation means to the mount position when said transfer device is mounted into said image forming apparatus.

13. A transfer unit according to claim 12, wherein said position control means is disposed at both ends of said transfer device along its width direction.

14. A transfer unit according to claim 13, further comprising a first frame supporting both ends of said transfer device, and a second frame rotatably supporting a portion of said first frame, wherein said position control means includes a regulator cam, rotatably supported by said second frame, which regulates a distance of a movement of said first frame, said manipulation means comprises an operation lever, and said coupling means is a member which transmits a turning of said operation lever to said regulator cam.

15. A transfer unit according to claim 14, wherein said manipulation means comprises a member rotatable by said operation lever, and said position retaining means comprises a hole provided in said rotatable member, and a projection formed in said second frame and engageable with the hole of said rotatable member when in said dismount position.

16. A transfer unit according to claim 15, wherein said returning means includes a mechanism for disengaging said projection from the hole of said rotatable member, and an elastic member for drawing said operation lever into the mounting position.

17. A transfer unit according to claim 14, wherein said position control means includes a presser cam rotatably supported by said second frame, and functioning to assume a pressing position, in which said transfer device is pressed against said photoconductor through means of said first frame, and a disengage position for releasing from the pressing position, said transfer unit further including:

a first rotator shaft which rotates together with said presser cam;

a second rotator shaft which rotates together with said operation lever;

a first disengage gear, partially provided with teeth along its circumference and fixed to said first rotator shaft, which, by the turning of said operation lever from the mount position to the dismount position, brings said pressing cam from the pressing position into the disengage position, and which prevents said presser cam in the dismount position from being rotated by the turning of said operation lever from the mount position to the dismount position; and a second disengage gear engageable with said first disengage gear, and fixed to said second rotator shaft, said second disengage gear having a gap along a portion of its circumference, which thereby prevents said operation lever in the mount position from being rotated by a rotation of said first rotator shaft.

18. A transfer unit according to claim 11, wherein said position control means is disposed at both ends of said transfer device along its width direction.

19. A transfer unit according to claim 18, further comprising a first frame supporting both ends of said transfer device, and a second frame rotatably supporting a portion of said first frame, wherein said position control means includes a regulator cam, rotatably supported by said second frame, which regulates a distance of a movement of said first frame, said manipulation means comprises an operation lever, and said coupling means is means for transmitting a turning of said operation lever to said regulator cam.

20. A transfer unit according to claim 19, wherein said position control means includes a presser cam rotatably supported by said second frame, and functioning to assume a pressing position, in which said transfer device is pressed against said photoconductor through means of said first frame, and a disengage position for releasing from the pressing position, said transfer unit further including:

a first rotator shaft which rotates together with said presser cam;

a second rotator shaft which rotates together with said operation lever;

a first disengage gear, partially provided with teeth along its circumference and fixed to said first rotator shaft, which, by the turning of said operation lever from the mount position to the dismount position, brings said pressing cam from the pressing position into the disengaging position, and which prevents said presser cam in the dismount position from being rotated by the turning of said operation lever from the mount position to the dismount position; and a second disengage gear engageable with said first disengage gear, and fixed to said second rotator shaft, said second disengage gear having a gap along a portion of its circumference, which thereby prevents said operation lever in the mount position from being rotated by a rotation of said first rotator shaft.

21. A transfer unit according to claim 10, further comprising manipulation control means for permitting said transfer device to be mounted into and dismounted from said image forming apparatus when said position control means is in the third position, and for forbidding the mounting and dismounting of said transfer device when said position control means is in either the first or the second position.

22. A transfer unit of an image forming apparatus, further comprising:

a transfer device disposed adjacent to a photoconductor of the image forming apparatus, and movable away from said photoconductor;

position control means for controlling positioning of said transfer device by assuming a first position for pressing said transfer device against said photoconductor, and a second position and a third position for spacing said transfer device from said photoconductor by a first distance and a greater second distance, respectively; and position retaining means for retaining said position control means in the third position.

23. A transfer unit according to claim 22, further comprising means for returning said position control means to the second position when said transfer device is mounted into said image forming apparatus.

24. A transfer unit of an image apparatus, comprising:

a transfer device disposed adjacent to a photoconductor of the image forming apparatus, and movable away from said photoconductor;

position control means for controlling positioning of said transfer device by assuming a first position for pressing said transfer device against said photoconductor, and a second position and a third position for spacing said transfer device from said photoconductor by a first distance and a greater second distance, respectively; and wherein said transfer device is removable from a body of said image forming apparatus, said transfer unit further including a pair of support plates disposed at both ends of said transfer device, with respect to a direction in which it is mounted and dismounted, for supporting said transfer device, one support plate of said pair toward a rear of said image forming apparatus having a cutout corresponding to a cross section of a path for printing material supplied to said transfer device.

25. A transfer unit mountable into and removable from an image forming apparatus, comprising:

a transfer device having a surface whereon printing material is retained; and a pair of support plates disposed at both ends of said transfer device along its mount/dismount direction, for supporting said transfer device, wherein a support plate of said pair toward a rear of said image forming apparatus includes a cutout which gives passage to printing material stopped in a transport path extending to said transfer device when said transfer unit is removed.

26. A transfer unit according to claim 25, further comprising a guide member which extends to an inlet of said transfer device and guides printing material thereto, wherein said cutout is provided so as to give passage to printing material stopped in said guide member when said transfer unit is removed.

27. A transfer unit according to claim 26, wherein said guide member is removable together with said transfer device.

28. A transfer unit according to claim 26, wherein said guide member includes a first guide plate and a second guide plate, each extending along a width direction of said transfer device, and the first guide plate located nearer to said transfer device is removable together with said transfer device, whereas the second guide plate is fixed to said image forming apparatus.

* * * * *